US012320209B2

(12) United States Patent
Linaker

(10) Patent No.: US 12,320,209 B2
(45) Date of Patent: Jun. 3, 2025

(54) SPACER SEGMENT AND A SPACER

(71) Applicant: KWIK-ZIP PTY LTD, Bunbury (AU)

(72) Inventor: Jason Linaker, Bunbury (AU)

(73) Assignee: KWIK-ZIP PTY LTD, Western Australia (AU)

( * ) Notice: Subject to any disclaimer, the term of this patent is extended or adjusted under 35 U.S.C. 154(b) by 0 days.

(21) Appl. No.: 17/904,557

(22) PCT Filed: Feb. 18, 2021

(86) PCT No.: PCT/AU2021/050140
§ 371 (c)(1),
(2) Date: Aug. 18, 2022

(87) PCT Pub. No.: WO2021/163759
PCT Pub. Date: Aug. 26, 2021

(65) Prior Publication Data

US 2023/0091111 A1 Mar. 23, 2023

(30) Foreign Application Priority Data

Feb. 18, 2020 (AU) ..... 2020900461

(51) Int. Cl.
*E21B 17/10* (2006.01)

(52) U.S. Cl.
CPC ..... *E21B 17/105* (2013.01); *E21B 17/1014* (2013.01); *E21B 17/1057* (2013.01); *E21B 17/1078* (2013.01)

(58) Field of Classification Search
CPC ..... E21B 17/1014; E21B 17/105; E21B 17/1057; E21B 17/1078; E21B 17/1085
See application file for complete search history.

(56) References Cited

U.S. PATENT DOCUMENTS 1,853,915 A 4/1932 McLaine et al.
1,893,020 A 1/1933 Cushing
(Continued)

FOREIGN PATENT DOCUMENTS

GB 682 362 11/1952
WO WO-9609459 A1 * 3/1996 ..... E21B 17/1078
(Continued)

OTHER PUBLICATIONS

KWIK-ZIP, HDX Pipeline Spacers [retrieved from internet on Apr. 28, 2021]<URL: http://web.archive.org/web/20190320034349/http://kwikzip.com/wp-content/uploads/sites/64/2018/05/kwikzip_hdx_brochure_18.pdf> published on Mar. 20, 2019 as per Wayback Machine, Copyright on p. 6 states 2018.
(Continued)

*Primary Examiner* — Daniel P Stephenson
(74) *Attorney, Agent, or Firm* — Gottlieb, Rackman & Reisman, PC

(57) ABSTRACT

The present invention provides a spacer (11) and a spacer segment (13). One or more spacer segments (13) form the spacer (11). The one or more spacer segments (13) are adapted to be interconnected and fitted to/on a first surface. The spacer segment (13) comprises a first collar portion (17), a second collar portion (19), and at least one support assembly (15) extending between the first collar portion and the second collar portion. The at least one support assembly is movable from a normal position, wherein no or minimal force is exerted on the support assembly, to a compressed position, wherein the support assembly supports a load or a portion of a load.

21 Claims, 16 Drawing Sheets

(56) References Cited

U.S. PATENT DOCUMENTS

| | | | | |
|---|---|---|---|---|
| 1,893,902 | A | 1/1933 | Meachem | |
| 1,940,332 | A | 12/1933 | Smith | |
| 2,594,551 | A * | 4/1952 | Gist | E21B 17/105 16/108 |
| 2,706,496 | A | 4/1955 | Bond | |
| 4,099,564 | A * | 7/1978 | Hutchison | F16L 1/026 166/241.1 |
| 6,637,511 | B2 * | 10/2003 | Linaker | E21B 17/1028 166/241.1 |
| 8,066,066 | B2 * | 11/2011 | Linaker | E21B 17/1021 166/241.1 |
| 9,341,032 | B2 * | 5/2016 | Jewett | E21B 17/1014 |
| 2007/0256750 | A1 | 11/2007 | Crook | |
| 2011/0079385 | A1 * | 4/2011 | Linaker | E02D 5/80 166/241.6 |
| 2015/0368990 | A1 | 12/2015 | Jewett | |
| 2019/0211896 | A1 * | 7/2019 | Prevost | E21B 17/1014 |
| 2023/0091111 | A1 * | 3/2023 | Linaker | E21B 17/1085 |

FOREIGN PATENT DOCUMENTS

| | | | | |
|---|---|---|---|---|
| WO | 97/12116 | 4/1997 | | |
| WO | 1999/042698 | 8/1999 | | |
| WO | WO-2010006357 A1 * | 1/2010 | | E21B 17/1021 |
| WO | 2015/122917 | 8/2015 | | |
| WO | WO-2016030689 A1 * | 3/2016 | | E21B 17/1014 |

OTHER PUBLICATIONS

International Search Report and Written Opinion, Australian Patent Office, Application No. PCT/AU2021/050140, Apr. 30, 2021.

Examination Report No. 1, Australian Patent Office, Application No. 2021223658, Feb. 9, 2024.

Examination Report No. 1, Australian Patent Office, Application No. 2022235524, Jan. 9, 2024.

Extended European Search Report, European Patent Office, Applicatin No. 21757137.1, Mar. 6, 2024.

* cited by examiner

SPACER SEGMENT AND A SPACER

FIELD OF THE INVENTION

The present invention relates to a spacer segment and a spacer formed from at least one or more spacer segments.

BACKGROUND

Spacers are commonly used when inserting a pipe, or similar into a bore wherein the bore has a greater diameter than the outside diameter of the pipe. A number of spacers are typically secured around the pipe at intermittent positions therealong before the pipe is inserted into the bore. As the pipe is inserted the spacers maintain a gap between the pipe and the bore wall such that the outside surface of the pipe remains spaced from the bore wall. This enables smooth installation and minimises damage to the pipe as well as the bore wall.

These spacers are also used as a centraliser to maintain the pipe being installed into the bore casing in a relatively central position of the bore. Centralisers may be used, for example, in water wells, oil wells and gas wells. When fitting the centraliser to the pipe it is necessary to first adjust the diameter of the centraliser so that the pipe is snugly supported in a vertical, central orientation in the borehole casing. A centraliser which has been previously proposed by the inventor is disclosed in AU200143778. A further centraliser which has been previously proposed by the inventor is disclosed in AU 2016203484.

While current spacers support the pipe as required, they are either too flexible to provide adequate support to a pipe being installed in a non-vertical orientation, or they are too inflexible resulting in point load concentrations on the pipe. These load concentrations hinder the installation of the pipe and can also lead to pipe damage.

The preceding discussion of the background art is intended to facilitate an understanding of the present invention only. The discussion is not an acknowledgement or admission that any of the material referred to is or was part of the common general knowledge as at the priority date of the application.

DISCLOSURE OF THE INVENTION

Embodiments of the present invention can be used to support and maintain a pipe or similar, away from a side wall of an enveloper. Other embodiments of the present invention seek to centralise a pipe, or similar, in an enveloper. In these latter embodiments, that is, where the spacer is to be used as a centraliser, the terms 'spacer' and 'spacer segment' may be replaced with the term 'centraliser' and 'centraliser segment'.

The enveloper provides an inner surface which has a larger diameter than the outside diameter of the pipe being received in the enveloper. The enveloper may include a hole in the ground, a casing positioned in a hole in the ground, a hollow pipe, a tunnel, or any other like structure as would be readily understood by the person skilled in the art.

The pipe being received in the enveloper may be in the form of a hollow pipe, a conduit, a cable, a solid shaft or any other like structure as would be readily understood by the person skilled in the art.

The spacer may be formed from a single spacer segment, a series of spacer segments interconnected with each other, or a series of spacer segments interconnected with each other and one or more extension straps extending between one or more adjacent spacer segments.

The present invention provides a spacer segment wherein one or more spacer segments are adapted to be interconnected and fitted to/on a first surface, the spacer segment comprises a first collar portion, a second collar portion, and at least one support assembly extending between the first collar portion and the second collar portion to maintain the collar portions in spaced relation to each other, the at least one support assembly being movable from a normal position, wherein no or minimal force is exerted on the support assembly, to a compressed position, wherein the support assembly supports a load or a portion of a load.

The spacer segments are able to distribute load across those support assemblies upon which the load is acting. In use the one or more support assemblies will move, at varying extents, towards the compressed position, depending on their location relative to the curvature of the first surface. As load is first encountered by a support assembly, it moves towards its compressed position. As this occurs adjacent support assemblies begin to take more load and also start to move towards their compressed position. This continues to additional adjacent support assemblies until the load is supported. In some prior art spacers, the support surfaces are rigid, resulting in the load being supported through less support points than the present invention. The higher concentration of loads at fewer points hinders installation and can lead to damage of pipe and/or enveloper.

The load may be provided by a pipe which the spacer segment is supporting. Where the spacer segment is providing a centraliser, the load on the at least one support assembly may be caused when the distance between the surface of the pipe and the surface of the bore casing is narrower than the depth of the at least one support assembly when in the normal position.

In one aspect of the invention the first surface to which one or more spacer segments are adapted to be fitted is an external surface of a pipe, or a portion of that external surface. The one or more spacer segments are adapted to be fitted around the perimeter of the external surface of the pipe.

One or more spacer segments may be fitted together to form a spacer which is fitted to the perimeter of the external surface of the pipe, wherein a plurality of spacers may be fitted to the external surface of the pipe in a spaced arrangement. The spacing between the plurality of spacers may not be even. The spacing may be determined by the particular application.

In another aspect of the invention the first surface to which one or more spacer segments are adapted to be fitted is an internal surface of an enveloper, or a portion of that internal surface. The one or more spacer segments are adapted to be fitted to at least a portion of the internal diameter of the external surface of the enveloper. The portion of the internal diameter may be the lower portion, or that portion of the enveloper which will support the weight of the pipe as and once it is installed.

One or more spacer segments may be fitted together to form a spacer which is fitted to at least the portion of the internal diameter of the enveloper, wherein a plurality of spacers may be fitted along the enveloper in a spaced arrangement. The spacing between the plurality of spacers may not be even. The spacing may be determined by the particular application.

In other embodiments one or more extension straps may interconnect adjacent one or more spacer segments to form the spacer. This negates the need to provide spacer segments around the entire perimeter of the pipe, or the internal surface of the enveloper, such as those applications where the pipe only needs to be supported along a portion of the enveloper Each support assembly may comprise a body which extends between the first collar portion and the second collar portion. The body may have a cavity with an opening, the opening being positioned adjacent the first surface when the spacer segment is fitted thereto.

Each support assembly may provide a contact surface, wherein the contact surface is adapted to engage a second surface.

In those embodiments where the first surface to which one or more spacer segments are adapted to be fitted is the external surface of the pipe, or a portion of that external surface, the second surface is provided by the internal surface of the enveloper.

In those embodiments where the first surface to which one or more spacer segments are adapted to be fitted is the internal surface of the enveloper, or a portion of that internal surface, the second surface is provided by the external surface of the pipe.

The contact surface may be spaced from the opening. The contact surface may be opposed to the opening of the cavity. The contact surface may have wear resistant properties. The contact surface may be elongate in shape whereupon installation, a longitudinal axis of the contact surface is orientated to extend along the direction the first surface and second surface move relative to each other.

The contact surface may have a ramped section at an end or a ramped section at both ends. The ramped section enables the spacer segment to engage with, and travel along irregular surfaces.

The contact surface may be the furthermost from the opening than the other components of the support assembly.

The contact surface may be provided by a wear pad. The wear pad may be releasably attached to the body of the support assembly. The wear pad may be positioned adjacent the second surface when the spacer segment is fitted to the first surface.

The wear pad may be movable relative to the body such that the support assembly moves between the normal position, whereby the pad is most distant from the body, and the compressed position, whereby the wear pad is closer to the body. The most compressed position may be just prior to a bottoming out orientation wherein the wear pad abuts the body such that there is no further movement of the wear pad towards the body.

The support assembly may comprise a suspension means biasing the contact surface outward away from the body. When load on the support assembly is removed, the suspension means returns the support assembly to the normal position. The suspension means may include a suspension device, a suspension apparatus, a suspension assembly. These may incorporate springs, resilient materials and/or resilient structures.

The suspension means may be provided by the body. The wear pad may be releasably attached relative to the suspension means. The suspension means may be located between the wear pad and the body. The suspension means may bias the wear pad away from the body such that when the support assembly has no load thereon the support assembly is in the normal position.

The body may be elongate in shape. The body may comprise a body portion and a mounting portion, the mounting portion being adapted to releasable attach the wear pad thereto.

The suspension means extends between the body portion and the mounting portion. The suspension means is in the form of a resilient portion extending between the body portion and the mounting portion. The resilient portion may be in the form of a wall portion. The wall portion may be flexible. The wall portion may have an s-shaped cross sectional profile.

In one aspect of the invention the wall portion may have a first edge which extends substantially around the perimeter of the mounting portion, and a second edge which extends substantially around the perimeter of the body portion.

In another aspect of the invention the wall portion may have a first edge which extends intermittently around the perimeter of the mounting portion, and a second edge which extends intermittently around the perimeter of the body portion.

The suspension means may be integrally formed with the body.

The mounting portion, the body portion and the wall portion may be integrally formed.

The mounting portion may provide a series of clips which are adapted to engage with the wear pad such that the wear pad may be releasably attached to the body.

The mounting portion may provide a central rib which extends outwardly from the body. The central rib may extend outwardly from the mounting portion.

The wear pad may be received over the central rib.

The body may be adapted to receive an adapter. The adapter may be used to strengthen the support assembly.

The adapter may be received in the cavity in the body of one or more support assemblies. The adapter may be made from a different material to the spacer segment and can be selected to increase the heat resistance of the spacer segment, and/or may be selected to increase the load capacity of the support assembly.

The spacer segment may provide a conveyancing means. The conveyancing means assists in installation and removal of the pipe as it is positioned in the enveloper.

The support assembly may provide the conveyancing means. The body may be adapted to support the conveyancing means. The conveyancing means may comprise one or more wheels located either side of the body. Preferably the conveyancing means comprises at least one pair of wheels, wherein the wheels are interconnected by an axle. The axle may be releasably secured to the body such that one wheel is located either side of the body.

In the embodiment comprising a conveyancing means, the wear pad may be positioned on the body once the wheels have been secured relative to the body. In alternative arrangements the conveyancing means may be secured to the wear pad. The conveyancing means may be secured to the wear pad either prior to or after the wear pad is attached to the body.

The conveyancing means may be in the form of a plurality of axle and wheel sets. In other arrangements the conveyancing means may be in the form of one or more rollers or bearings supported in the wear pad.

The supported assembly comprising the conveyancing means is adapted to support the weight of the pipe while allowing for greater manoeuvrability when installing/removing the pipe relative to the enveloper. The number of support assemblies requiring a conveyancing means can be tailored according to the pipe being installed.

The spacer segment may be formed from material having heat and corrosive resistant properties. Parts of the spacer segment may be formed from material having higher heat and corrosive resistant properties than other parts of the spacer segment.

Preferably a first connector element is provided at one end of each collar portion of the spacer segment. Each first connector element may comprise a receiving passage.

Preferably a second connector element is provided at the other end of each collar portion. Each second connector element may comprise an elongate element which in use is able to be received in the receiving passage of the first connector elements to be slidable therealong.

Each first connector element is engageable with the respective second connector element of the same or another spacer segment such that one or more spacer segments are able to form a spacer which in use is capable of being received around a first surface, and secured thereto.

Each first connector element has an adjustment element cooperating with the receiving passage and the elongate element to adjust the position of the elongate element within the passage.

Adjusting the elongate element relative to the receiving passage may result in securing the spacer relative to the first surface.

The spacer may also be secured to the first surface using fasteners, adhesives or other known means.

In accordance with a further aspect of the present invention, there is provided a spacer segment comprising a first collar portion, a second collar portion, the collar portions having an inner face and an outer face, the spacer segment further comprising at least one support assembly extending between the first collar portion and the second collar portion to maintain the collar portions in spaced relation to each other, the at least one support assembly providing a contact portion which is in spaced relation from the outer face of the collar portions, the contact portion is adapted to move between a normal position wherein the spacer segment has no load thereon, toward a compressed position, wherein the spacer segment has a load thereon, a first connector element provided at one end of each of the collar portions wherein the first connector element comprises a passage formed along the respective collar portion to extend inwardly from the respective end and second connector element provided at the other end of each of the collar portions, the second connector element comprising an elongate element which in use is able to be received in the passage to be slidable along the passage, wherein the first connector elements are engageable with the second connector elements of the same or another spacer segment such that one or more spacer segments are able to form a spacer which in use is capable of being received around a first surface such that the elongate element is received between the inner face and the second surface, the first connector element having an adjustment element cooperating with the passage and the elongate element to control the position of the elongate element within the passage, wherein the adjustment element comprises a threaded element rotatably supported adjacent the passage and wherein the elongate element is formed with a set of serrations along at least a portion of its length, the spacing between the serrations conforming to the thread of the threaded element, wherein in use when the elongate element is received in the passage the thread of the threaded element is engaged with the serrations such that rotation of the threaded element causes relative displacement between the passage and the elongate element.

The at least one support assembly may comprise a suspension means biasing the contact portion towards the normal position, such that when any load is removed from the spacer segment the contact portion returns to the normal position.

The at least one support assembly may comprise a body and a removable pad, wherein the pad provides the contact portion. The suspension means may be provided by the body. The pad may be releasably attached to the suspension means. The suspension means may be located between the pad and the body. The suspension means may bias the pad away from the body such that when the support assembly has no load thereon the support assembly is in the normal position.

The suspension means may be provided by a resilient wall portion. The resilient wall portion may be integrally formed so as to be incorporated with the body. The resilient wall portion may flex as load is applied thereto. The resilient wall portion may have an S-shaped cross section. In other embodiments the resilient wall portion may have a cross section shaped like a '2'.

According to a preferred feature of the invention the passage comprises a channel formed in the inner face of the respective collar portions.

According to a preferred feature of the invention the threaded element is rotatable about an axis which is inclined with respect to the axis of the passage and a portion of the thread extends into the passage. According to a preferred feature of the invention one end of the threaded element is supported upon a spigot which is received in a hollow bore of the traded member. According to a preferred feature of the invention the first connector element is formed as a housing at the one end of the collar, the passage being formed at an inner face of the housing and being a continuation of the inner face of the collar. According to a preferred feature of the invention the passage is formed in part by a passageway at the one end of the collar, the passageway being configured to slidingly receive the elongate element.

According to a preferred feature of the invention the passage is formed in part by a pair of side elements located at the one end of the collar and located to each side of the inner face, each side element having an inwardly directed flange at their outer edge, the spacing between the side portions corresponding at least to the width of the elongate element and the spacing between the flanges and the inner face corresponding at least to the thickness of the elongate element.

According to a preferred feature of the invention wherein the at least support assembly is flexibly resilient.

According to a preferred feature of the invention the first and second collar portions are substantially parallel.

According to a preferred feature of the invention the first and second collar portions are provided as strap-like members.

According to a preferred feature of the invention the spacer segment is made of a corrosion resistant material.

According to a preferred feature of the invention the inner face of at least one of the connectors and/or the collars, or a portion thereof, has a high coefficient of friction with the first surface. This may be provided by at least one high friction pad applied to or formed in at least one of the connectors and/or the collars.

According to another aspect the invention resides in a spacer adapted to be fitted to a first surface, the spacer comprises a spacer segment as herein described wherein the ends of the spacer segments are connected together via their first and second connector element.

The spacer may incorporate extension straps extending between ends of the spacer segment.

According to another aspect the invention resides in a spacer adapted to be fitted to a first surface, the spacer comprises a plurality of spacer segments as herein described wherein the ends of the spacer segment are connected to its adjacent spacer segment via their first and second connector element.

The spacer may incorporate extension straps extending between adjacent spacer segments.

The present invention provides a spacer segment wherein one or more spacer segments are adapted to be interconnected and fitted to/on a first surface, the spacer segment comprises a first collar portion, a second collar portion, and at least one support assembly extending between the first collar portion and the second collar portion to maintain the collar portions in spaced relation to each other, the at least one support assembly being movable from a normal position, wherein no or minimal force is exerted on the support assembly, to a compressed position, wherein the support assembly supports a load or a portion of a load.

The present invention provides a spacer segment wherein one or more spacer segments are adapted to be interconnected and fitted to/on a first surface, the spacer segment comprises a plurality of support assemblies in parallel spaced relation, each support assembly being movable from a normal position, wherein no or minimal force is exerted on the support assembly, to a compressed position, wherein the support assembly supports a load or a portion of a load.

The at least support assembly may provide a flexibly resilient portion.

The support assembly may be elongate. The support assembly may have an outer face having a convex transverse cross sectional profile. The support assembly may have a channel shaped cross section. The edges of the channel section may be provided with laterally directed flanges.

The present invention further provides a spacer segment wherein one or more spacer segments are adapted to be interconnected and fitted to/on a first surface, the one or more spacer segment comprise a first collar portion, a second collar portion, and a plurality of support assemblies extending between the first collar portion and the second collar portion to maintain the collar portions in spaced relation to each other, each support assembly is biased to a normal position and is movable from the normal position, wherein no or minimal force is exerted on the support assembly, toward a compressed position, wherein the support assembly supports a load or a portion of a load.

According to another aspect the invention resides in comprising at least two spacer segments, as described above wherein the ends of the spacer segments are connected together via the first and second connector element around relative to a first surface.

The present invention further provides a spacer comprising at least one or more spacer segments as herein described.

The present invention further provides an extension strap as herein described.

The present invention further provides a spacer segment wherein one or more spacer segments are adapted to be interconnected and fitted to/on a first surface, the spacer segment comprises a plurality of support assemblies in parallel spaced relation, each of the plurality of support assemblies comprising a body portion and a wear pad interconnected by a suspension means, wherein the suspension means biases the wear pad away from the support assembly, wherein each support assembly is movable between a normal position, wherein no or minimal force is exerted on the support assembly and the wear pad is spaced at its maximum distance from the body portion, and a compressed position, wherein the support assembly supports a load or a portion of a load whereupon the wear pad is closer to the body portion.

The present invention further provides a spacer segment wherein one or more spacer segments are adapted to be interconnected and fitted to/on a first surface, the spacer segment comprises a first collar portion, a second collar portion, and at least one support assembly extending between the first collar portion and the second collar portion to maintain the collar portions in spaced relation to each other, the at least one support assembly comprises a body, a contact surface adapted to engage a second surface of a structure, and a suspension means for biasing the contact surface away from the body, wherein the at least one support assembly is movable from a normal position, wherein no or minimal force is exerted on the support assembly and the contact surface is biased away from the body, to a compressed position, wherein the at least one support assembly supports a load or a portion of a load, whereupon the contact surface is caused to move towards the body.

The present invention further provides a spacer segment comprising a first collar portion, a second collar portion, the collar portions having an inner face and an outer face, the spacer segment further comprising at least one support assembly extending between the first collar portion and the second collar portion to maintain the collar portions in a fixed spaced relation to each other, the at least one support assembly comprising a suspension means and a contact portion which is biased by the suspension means in a spaced relation from the outer face of the collar portions, the contact portion is adapted to move between a normal position wherein the spacer segment has no load thereon, toward a compressed position, wherein the spacer segment has a load thereon, a first connector element provided at one end of each of the collar portions wherein the first connector element comprises a passage formed along the respective collar portion to extend inwardly from the respective end and second connector element provided at the other end of each of the collar portions, the second connector element comprising an elongate element which in use is able to be received in the passage to be slidable along the passage, wherein the first connector elements are engageable with the second connector elements of the same or another spacer segment such that one or more spacer segments are able to form a spacer which in use is capable of being received around a first surface such that the elongate element is received between the inner face and the second surface, the first connector element having an adjustment element cooperating with the passage and the elongate element to control the position of the elongate element within the passage, wherein the adjustment element comprises a threaded element rotatably supported adjacent the passage and wherein the elongate element is formed with a set of serrations along at least a portion of its length, the spacing between the serrations conforming to the thread of the threaded element, wherein in use when the elongate element is received in the passage the thread of the threaded element is engaged with the serrations such that rotation of the threaded element causes relative displacement between the passage and the elongate element;

wherein the suspension means biases the contact portion towards the normal position, such that when any load is removed from the spacer segment the contact portion returns to the normal position.

The present invention further provides a spacer segment comprising a spacer segment wherein one or more spacer segments are adapted to be interconnected and fitted to/on a first surface, the one or more spacer segment comprise a first collar portion, a second collar portion, and a plurality of support assemblies extending between the first collar portion and the second collar portion to maintain the collar portions in spaced relation to each other, each support assembly is biased to a normal position and is movable from the normal position, wherein no or minimal force is exerted on the support assembly, toward a compressed position, wherein the support assembly supports a load or a portion of a load.

The present invention further provides a spacer segment wherein one or more spacer segments are adapted to be interconnected and fitted to/on a first surface, the spacer segment comprises a plurality of support assemblies in parallel spaced relation, each of the plurality of support assemblies comprising a body portion and a wear pad interconnected by a suspension means, the suspension means is provided by a resilient wall portion, the resilient wall portion being integrally formed so as to be incorporated with the body portion, the wall portion has a curved cross sectional profile which spans between a first edge extending substantially around the perimeter of the mounting portion, and a second edge extending substantially around the perimeter of the body portion, wherein the resilient wall portion flexes as load is applied thereto, wherein the suspension means biases the wear pad away from the support assembly, wherein each support assembly is movable between a normal position, wherein no or minimal force is exerted on the support assembly and the wear pad is spaced at its maximum distance from the body portion, and a compressed position, wherein the support assembly supports a load or a portion of a load whereupon the wear pad is closer to the body portion.

BRIEF DESCRIPTION OF THE DRAWINGS

Further features of the present invention are more fully described in the following description of several non-limiting embodiments thereof. This description is included solely for the purposes of exemplifying the present invention. It should not be understood as a restriction on the broad summary, disclosure or description of the invention as set out above. The description will be made with reference to the accompanying drawings in which.

In the drawings like structures are referred to by like numerals throughout the several views. The drawings shown are not necessarily to scale, with emphasis instead generally being placed upon illustrating the principles of the present invention.

DETAILED DESCRIPTION OF SPECIFIC EMBODIMENT

Figure 1:
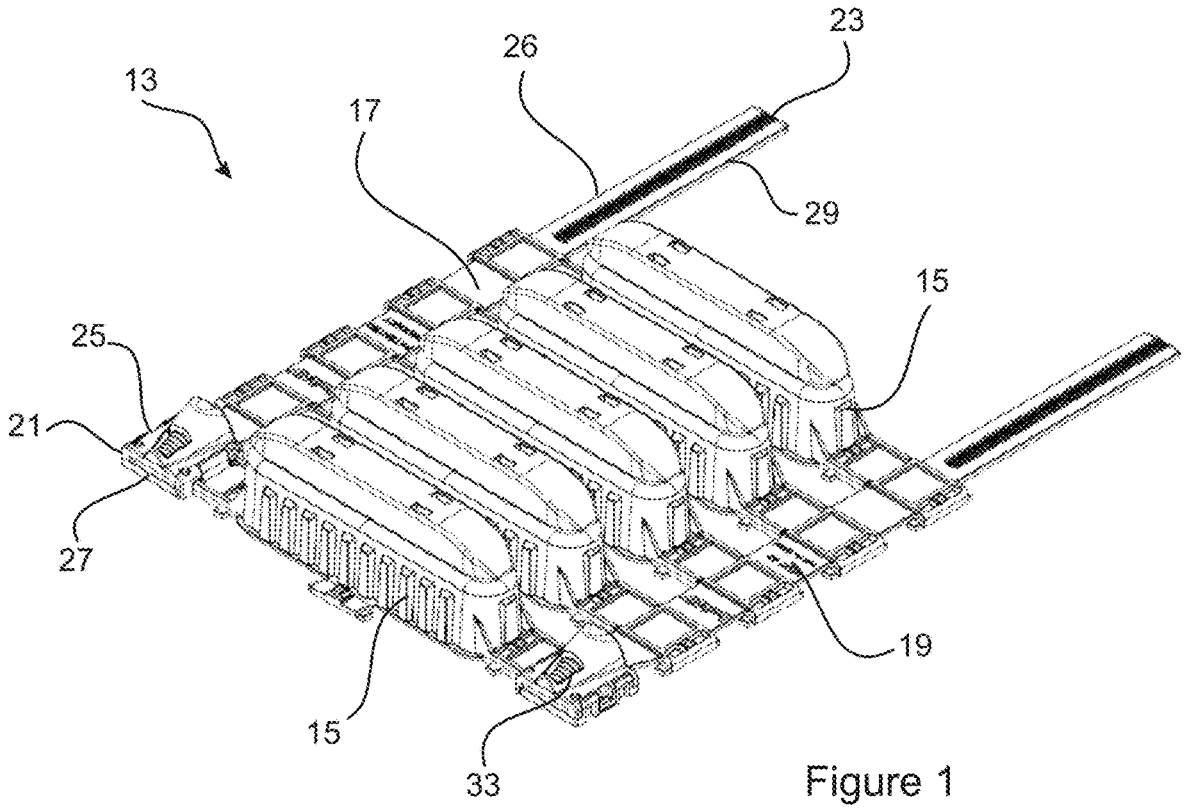
FIG. 1 is a top perspective view of a spacer segment according to a first embodiment of the present invention.
Figure 2:
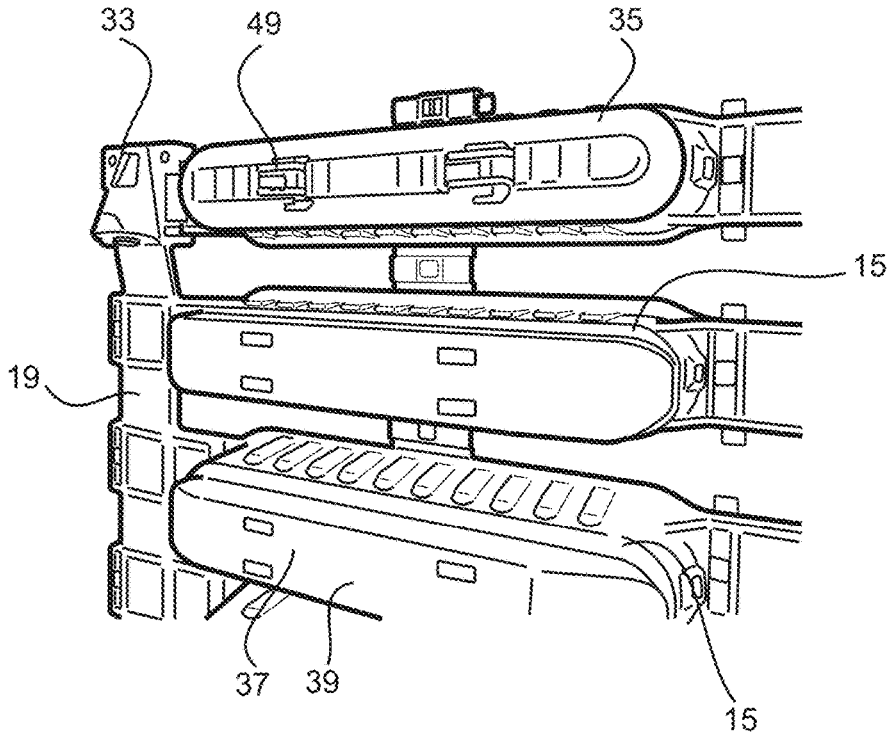
FIG. 2 is a perspective view of one end of the spacer segment of FIG. 1, showing three support assemblies wherein one of the support assemblies has a wear pad removed therefrom.
Figure 3:
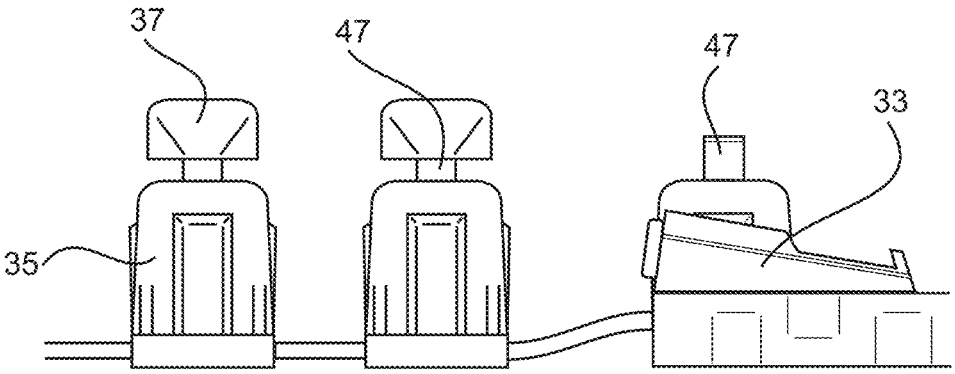
FIG. 3 is an end view of FIG. 2.
Figure 4:
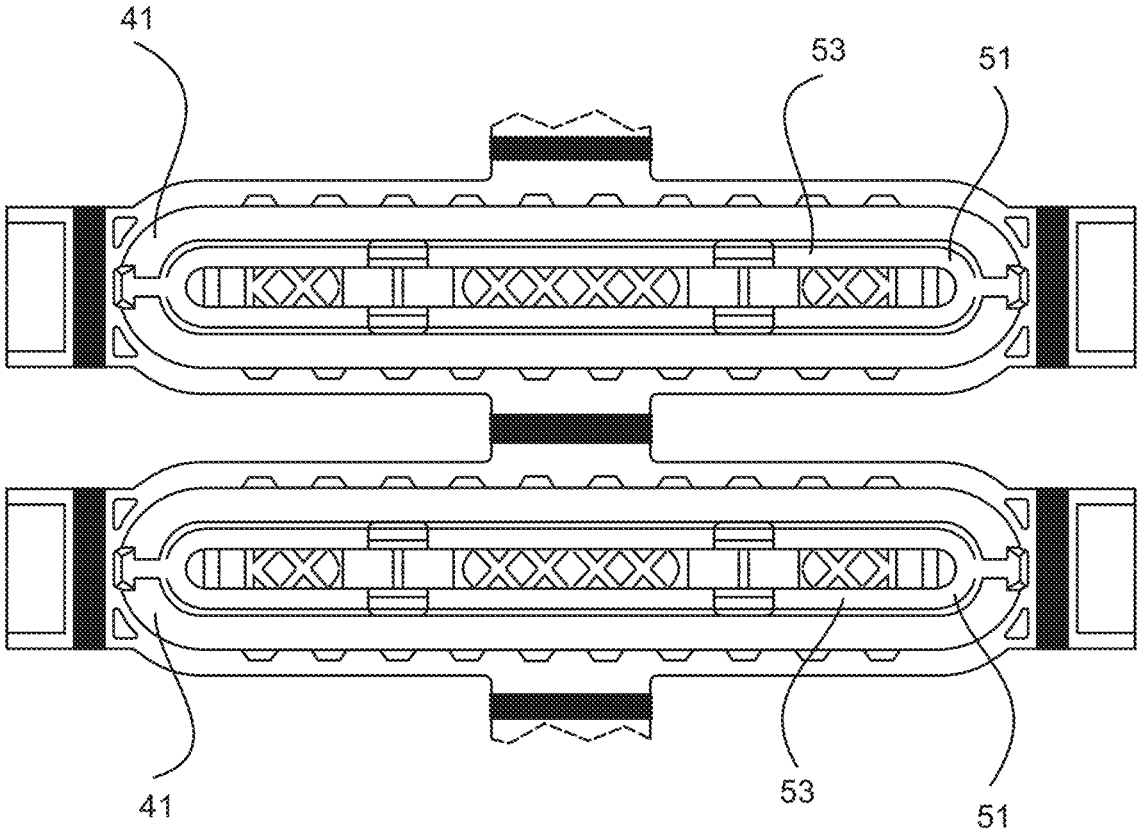
FIG. 4 is a bottom view of the spacer segment of FIG. 2, showing only two support assemblies.
Figure 5:
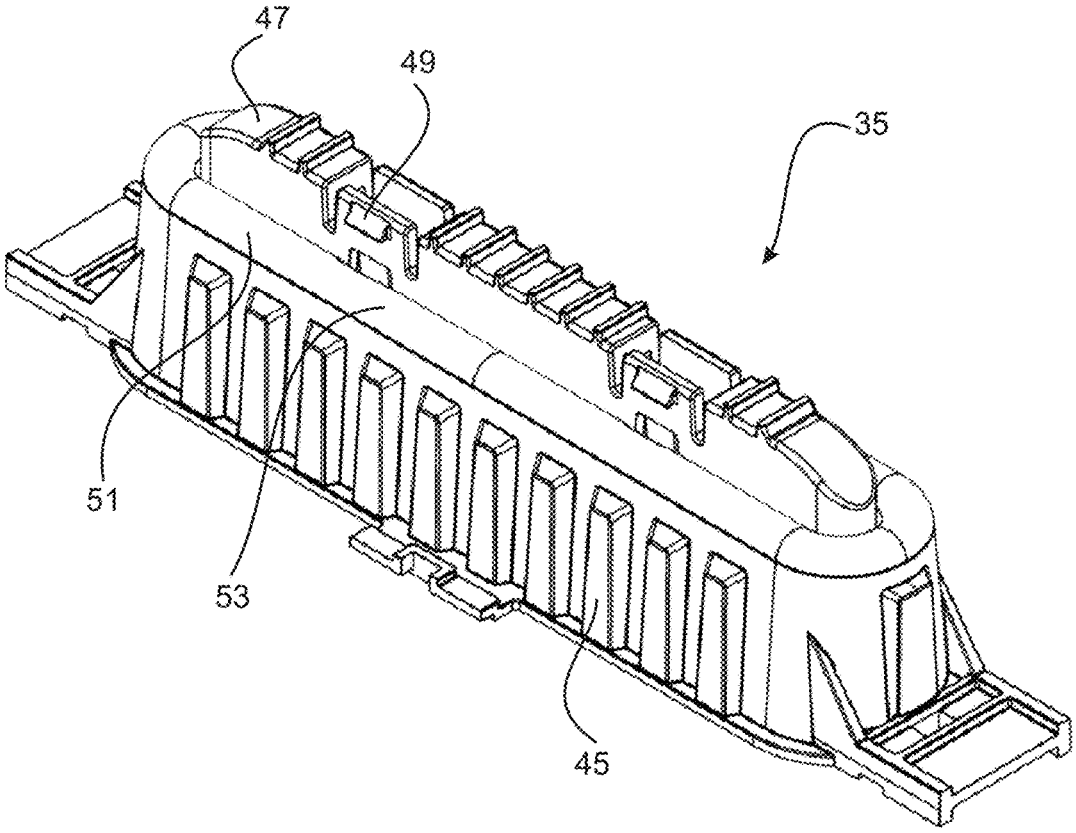
FIG. 5 is a perspective view of a body of the support assembly of the spacer segment of FIG. 1.
Figure 6:
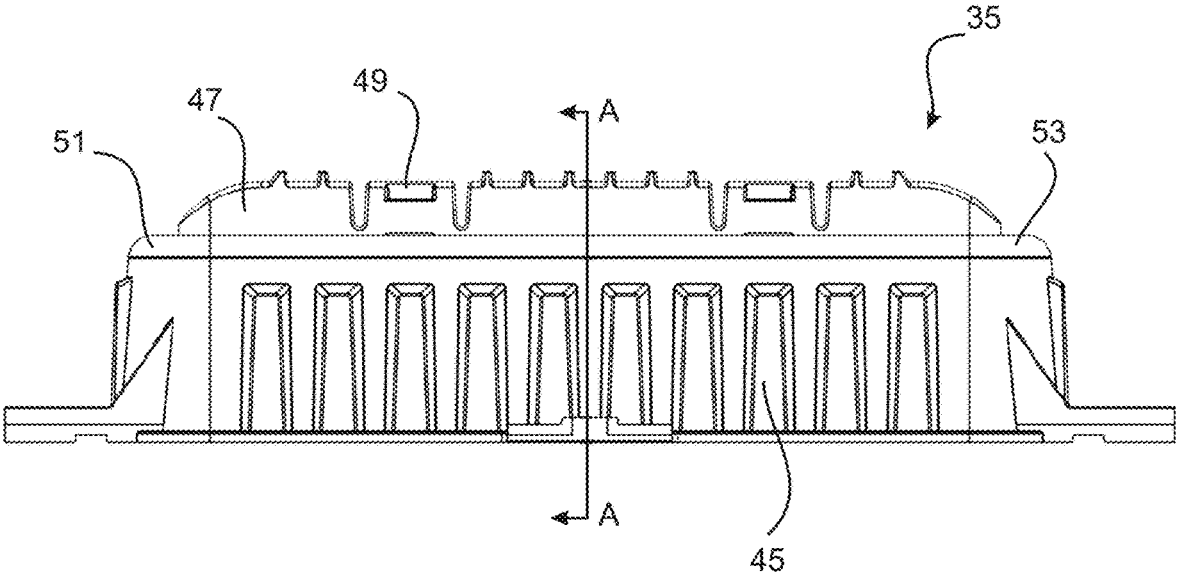
FIG. 6 is a side view of the body shown in FIG. 5.
Figure 7:
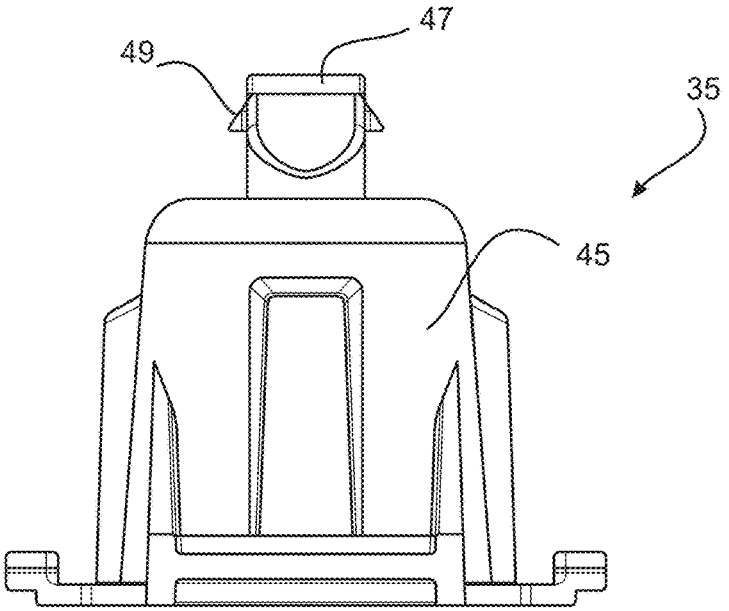
FIG. 7 is an end view of the body shown in FIG. 5.

The present invention provides a spacer and a spacer segment.

The present invention generally has applications in respect of the installation of a first pipe in an enveloper, such as a larger second pipe. Once installed the present invention supports the pipe in a spaced relation to the second pipe.

In non-vertical installations, embodiments of the present invention assist the installation of the first pipe in the second pipe by providing a means by which irregularities in the internal surface of the second pipe or the external surface of the first pipe can be overcome. The present invention also minimises potential damage to both pipes. In other embodiments installation is further enhanced by having a spacer with a conveyancing means thereon.

In vertical installations, embodiments of the present invention assist the installation of the first pipe in the second pipe by centralising the first pipe relative to the second pipe. These embodiments are able to accommodate variances in the distance between the internal surface of the second pipe and the external surface of the first pipe. In subsequent embodiments this is further enhanced by having a spacer with a conveyancing means thereon.

Embodiments of the present invention provide a spacer wherein the spacer may comprise one or more spacer segments, or a combination of one or more spacer segments and one or more pairs of extension straps.

The spacer is fitted relative to a first surface, and provides a contact surface or portion adapted to travel relative to a second surface. In many applications the contact surface or portion will engage the second surface.

Referring to FIGS. 1 to 4 a spacer segment 13 according to a first embodiment is shown. The spacer segment 13 comprises five support assemblies 15 extending between a first collar portion 17 and a second collar portion 19, maintaining the collar portions 17, 19 in a parallel spaced relation to each other. In other embodiments, the spacer segment may comprise one or more support assemblies as may be required by the application.

Each collar portion 17, 19 has a first connector element 21 provided at a first end portion 25 thereof. Each first connector element 21 provides a receiving passage 27, for reasons discussed below.

Each collar portion 17, 19 has a second connector element 23 provided at a second end portion 26. Each second connector element 23 comprise an elongate element 29.

When forming a spacer 11 each elongate element 29 of each second connector element 23 is slidingly received in the receiving passage 27 of each first connector element 21.

Where the spacer 11 comprises one spacer segment 13 the ends of the first collar portion 17 are connected together, and the ends of the second collar portion 19 are connected together to form the spacer 11. In particular each elongate element 29 is received in the respective receiving passage 27.

Where the spacer 11 comprises more than one spacer segment 13*a*, 13*b*, the spacer segments 13*a*, 13*b* are configured to be interconnected. In this regard the end of the first collar portion 17*a* of one spacer segment 13*a* is connected to the end of the first collar portion 17*b* of the adjacent spacer segment 13*b*. Similarly the end of the second collar portion 19*a* is connected to the end of the second collar portion 19*b* of the adjacent spacer segment 13*b*.

The first connector element 21 is adapted to receive the second connector element 23 of the same collar portion 17, 19 when the spacer 11 is formed from a single spacer segment 13. Where the spacer 13 is formed from a number of spacer segments 13, the first connector element 21 is adapted to receive the second connector element 23 of the respective collar portion 17, 19 of the adjacent spacer segment.

When the elongate element 29 of the second connector element 23 is received in the receiving passage 27 of the first connector element 21, the elongate element 29 may be releasably fixed relative to the receiving passage 27. As a result the spacer 11 is able to be fixed to a first surface 61. Other means of fixing the spacer 11 in place include screws 31 (see FIGS. 18 and 19) and glue.

Each first connector element 21 has an adjustment element 33 which cooperates with the receiving passage 27 and the elongate element 29 to adjust the position of the elongate element 29 within the receiving passage 27. Adjusting the adjustment element 33 will move the elongate element 29 relative to the receiving passage 27. Continued adjustment once the spacer 11 is in place can result in tightening of the spacer 11 until the spacer is fixed relative to the first surface 61.

Each support assembly 15 is of a generally elongate shape and comprises a body 35 and a wear pad 37. The wear pad 37 provides a contact surface 39.

Referring to FIGS. 5 to 9, the body 35 is of hollow construction, providing a cavity 41 having an opening 43. When the spacer 11 is installed, the opening 43 lies adjacent the first surface 61 . . . . In other embodiments, the body 35 may have a bottom surface, and may have a bottom surface which is curved to accommodate the curve of the first surface.

The body 35 comprises a body portion 45 and a mounting portion 47.

The mounting portion 47 provides a number of clips 49 which co-operate with mating recesses (not shown) in the wear pad 37 to releasably secure the wear pad 37 to the body 35 of the support assembly.

The body 35 also comprises a suspension means 51 which enables the support assembly to move from a normal position, when there is no load exerted on the support assembly 15, towards a compressed position, once a load has been applied to the support assembly 15.

When the spacer 11 is fitted relative to the first surface, the contact surface 39 is at its furthest from the first surface when the support assembly 15 is in the normal position compared to its position once the support assembly 15 moves toward the compressed position.

Figure 8:
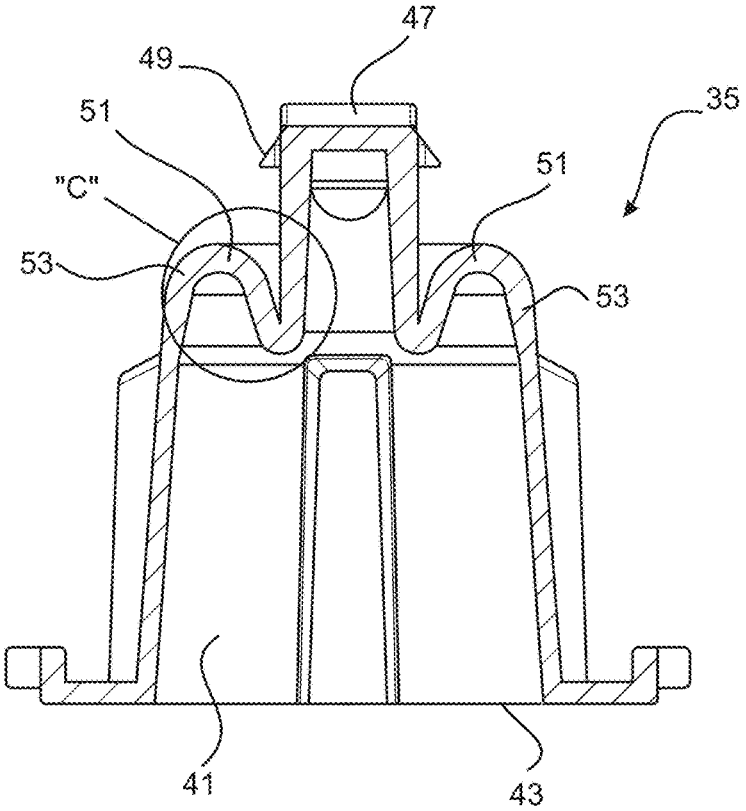
FIG. 8 is a cross sectional view of the body taken through section AA of FIG. 6.
Figure 9:
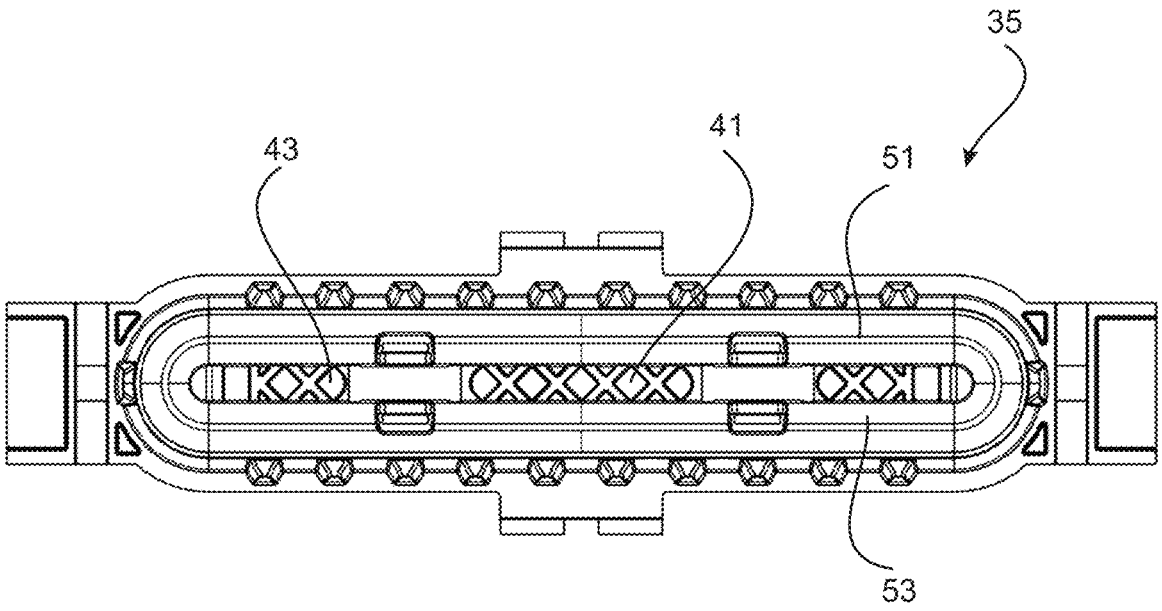
FIG. 9 is a bottom view of the body shown in FIG. 5.

The suspension means 51 extends between the body portion 45 and the mounting portion 47. The suspension means 51 is in the form of a resilient wall portion 53 connecting the body portion 45 and the mounting portion 47. As best shown in FIG. 8 the resilient wall portion 53 has an s-like-shaped configuration, as highlighted by "C" in FIG. 8. In some applications the resilient wall portion 53 is configured to allow for 10 mm of deflection of the contact surface 39. This of course can vary either way based on the configuration of the resilient wall portion 53

When the support assembly 15 experiences a load, the resilient wall portion 53 allows movement of the mounting portion 47 (and the wear pad when attached thereto) into/toward the cavity 41 of the body 35. When the load is removed, the resilient nature of the resilient wall portion 53 returns the mounting portion to its original position, wherein the support assembly is in the normal position.

The mounting portion 47, the body portion 45 and the wall portion 53 are integrally formed.

Figure 10:
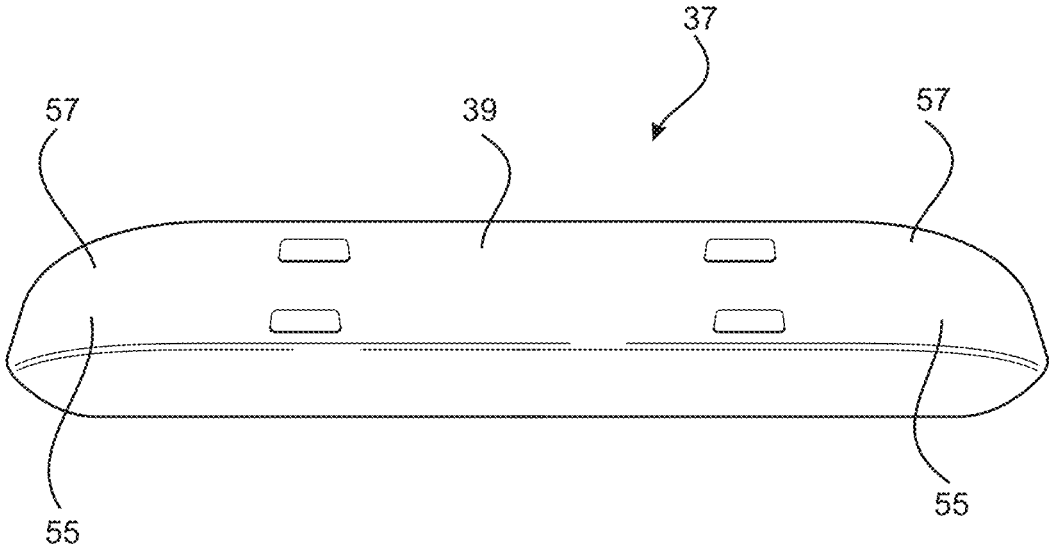
FIG. 10 is a perspective view of the wear pad.

As shown in FIG. 10, the wear pad 37 incorporates a ramp 55 at each end 57. The ramp provides an inclined surface 59 to assist the spacer 11 in moving over irregularities in a second surface 63 of the pipe in which it is being installed.

Figure 11:
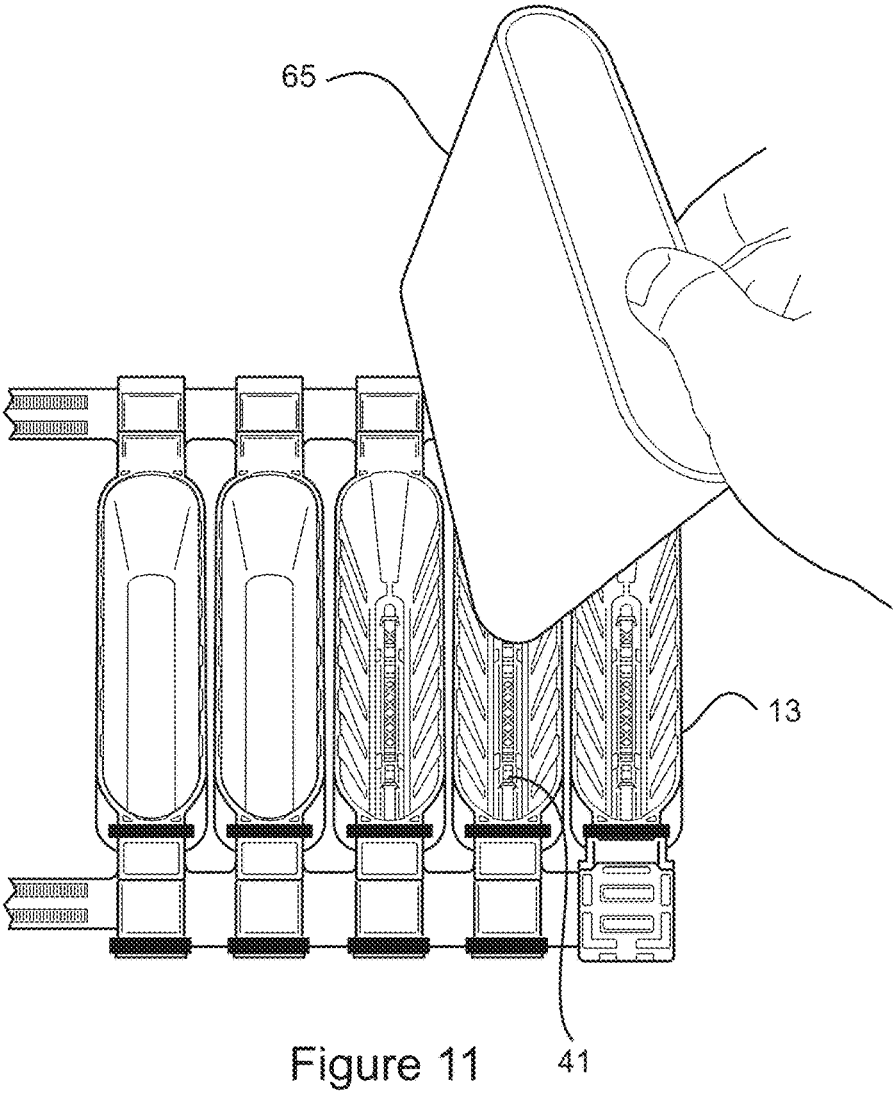
FIG. 11 is a bottom view of the spacer segment of FIG. 2 wherein two support assemblies have an adapter inserted therein and another adapter is being inserted in a third support assembly.

Depending on the conditions of the installation and in particular the load on the spacer 11, the spacer may require additional strength. This may be achieved by inserting an adapter 65 in one or more of the cavities 41 of the body 35, as shown in FIG. 11. The adapter 65 may be made of stronger material than the body 35 to further increase the strength of the support assembly 15.

Figure 12:
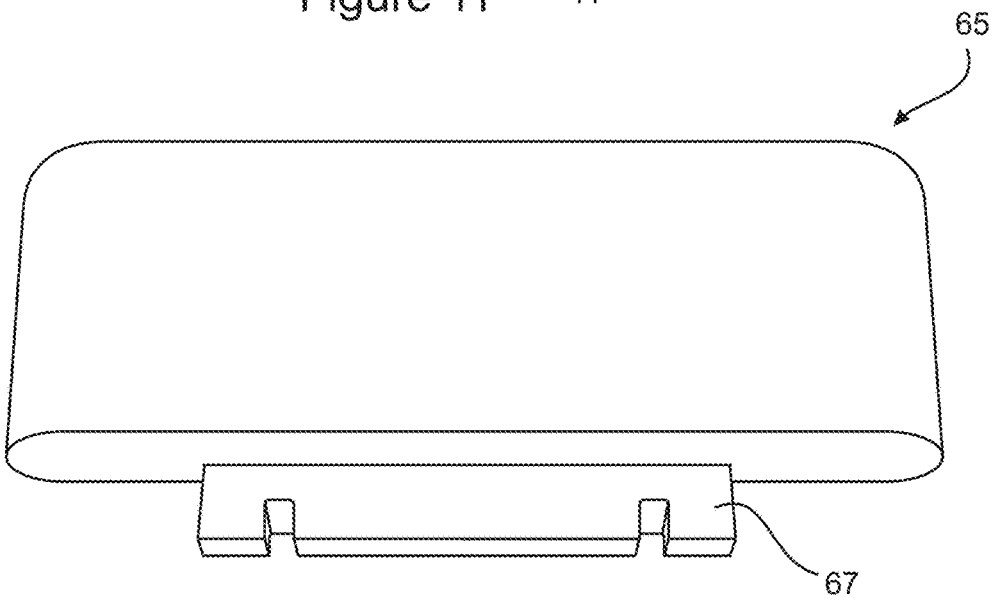
FIG. 12 is a side view of an adapter similar to those shown in FIG. 11.

Referring to FIG. 12, the adapter 65 has a projecting wall 67 extending from an upper surface. The projecting wall 67 can define the lowermost point the mounting portion can deflect into the cavity, therefore defining the lowest compressed position of the support assembly 15.

Referring to FIGS. 13 to 21, the spacer formed from one or more spacer segments 13 according to the first embodiment is shown as it may be applied in different applications.

Considering the applications depicted in FIGS. 13 to 16, the first surface 61 to which the spacer 13 is fitted is provided by the outer surface 69 of a first pipe 71. The second surface 63 is provided by an inner surface 73 of an enveloper such as a second pipe 75.

Figure 13:
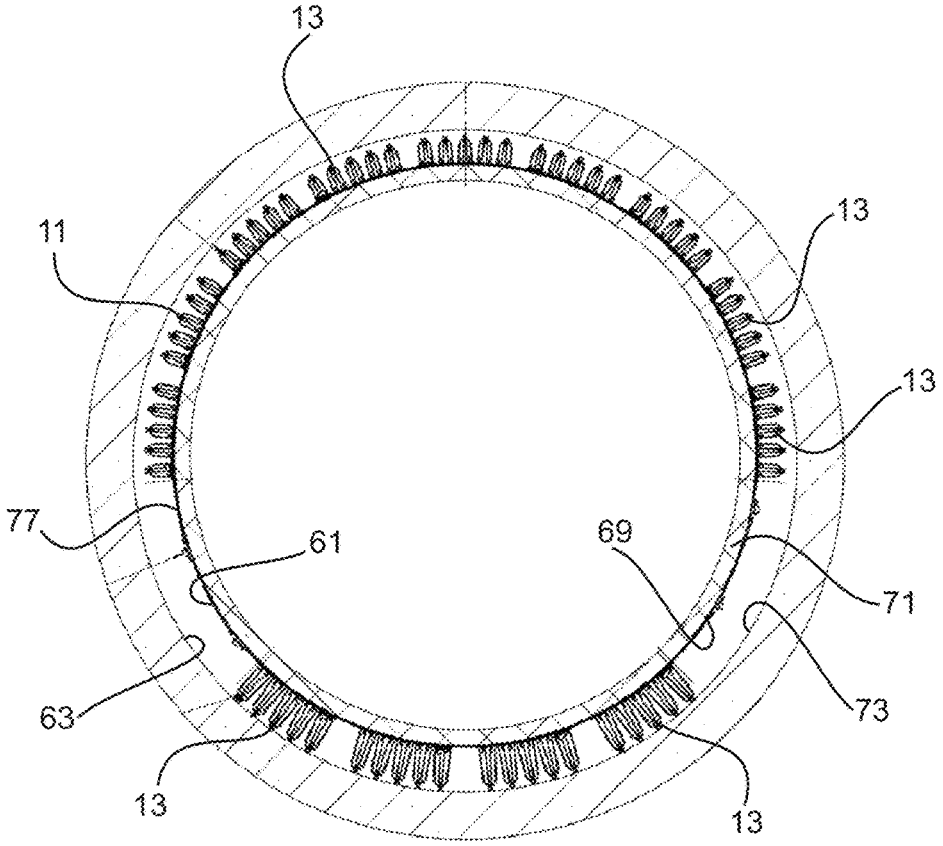
FIG. 13 is a cross sectional end view of a spacer in a first application, the spacer comprising a plurality of spacer segments fitted to a first surface, the first surface being provided by the external surface of a pipe, the pipe being received in an enveloper, being a bore casing, the internal surface of the enveloper providing a second surface.
Figure 14:
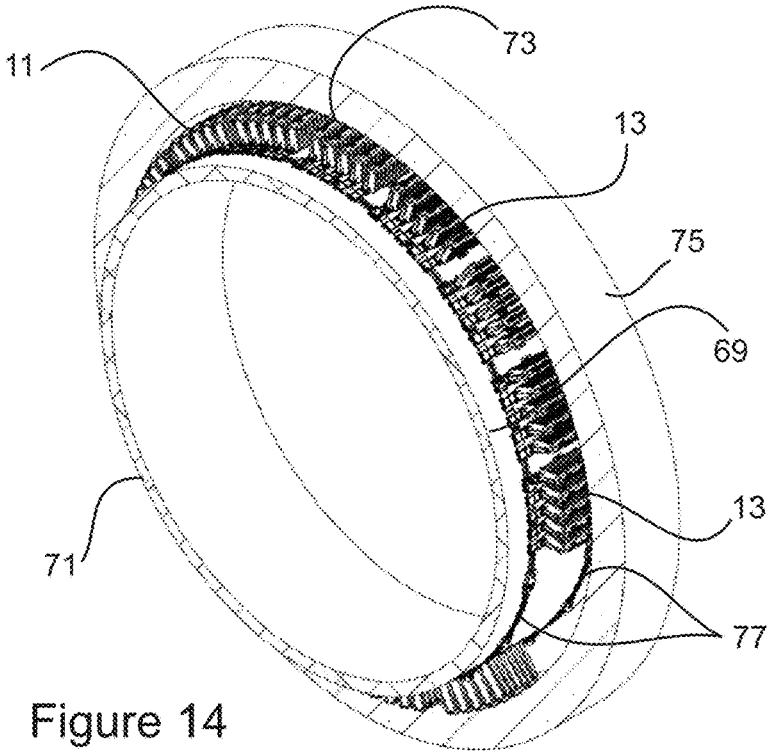
FIG. 14 is a perspective view of FIG. 13.

Referring to the first application shown in FIGS. 13 and 14, a plurality of spacers 11 is fitted to the first surface 69 before the first pipe 71 is installed in the second pipe 75. This is achieved by sliding/inserting the first pipe 71 into the second pipe 75. In this application the spacer 11 comprises thirteen spacer segments 13. The spacer 11 also comprises two pair of extension straps 77. Extension straps may be used in those positions around the circumference of the first pipe 71 which do not require support.

Figure 31:
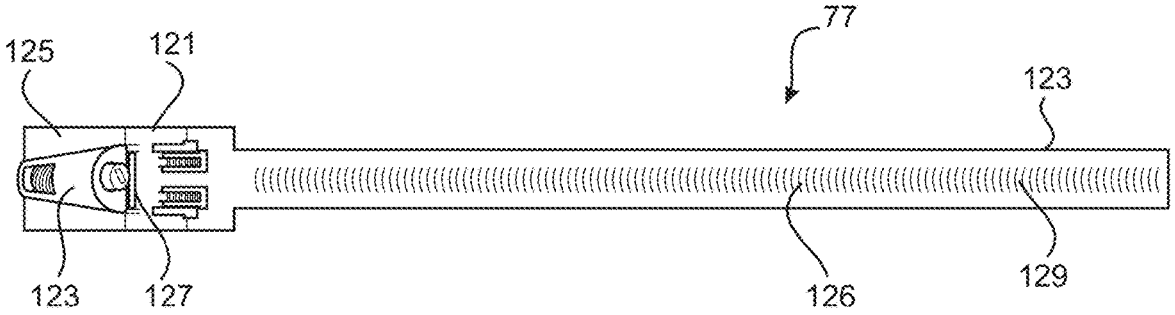
FIG. 31 is a plan view of an extension strap, the extension strap being adapted to extend between spacer segments . . .

An extension strap 77 is shown in FIG. 31. The extension strap is similar in configuration to the collar portions described above, and may be of any length. The extension strap 77 has a first connector element 121 provided at a first end portion 125 thereof. The first connector element 121 provides a receiving passage 127.

The extension strap 77 has a second connector element 123 provided at a second end portion 126. The second connector element 123 comprises an elongate element 129. Which is slidingly received in the receiving passage 127.

The extension strap's elongate element 129 may be received in the receiving passage 127 of another extension strap, or in the receiving passage 27 of a spacer segment 13. Similarly the receiving passage 27 of a spacer segment 13 can receive the elongate element 129 of an extension strap.

The extension strap 77 also comprises an adjustment element 133 which acts in the same manner as the adjustment element 33 of the spacer segment 13, as described above.

It is worth noting that the spacer segments 13 may have support bodies which vary in height. For instance the support assemblies of the spacer segments which are to be located at the bottom of the first pipe may be higher/deeper than those support assemblies of the spacer segments located on the side or at the top of the first pipe.

Figure 15:
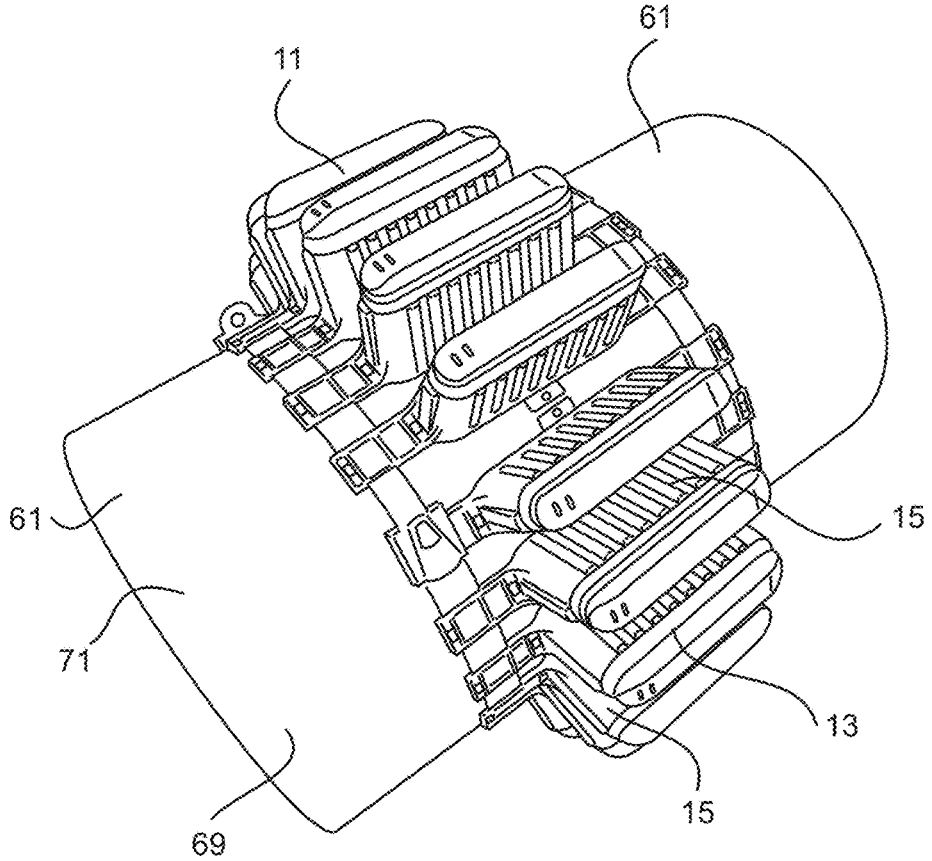
FIG. 15 is a perspective view of a spacer in a second application, the spacer comprising a plurality of spacer segments fitted to a first surface, the first surface being provided by the external surface of a pipe.

Referring to a second application of a spacer 11 shown in FIG. 15, the height/depth of the support assemblies 15 can be selected to accommodate large or small gaps between the first surface 61 and the second surface 63.

Figure 16:
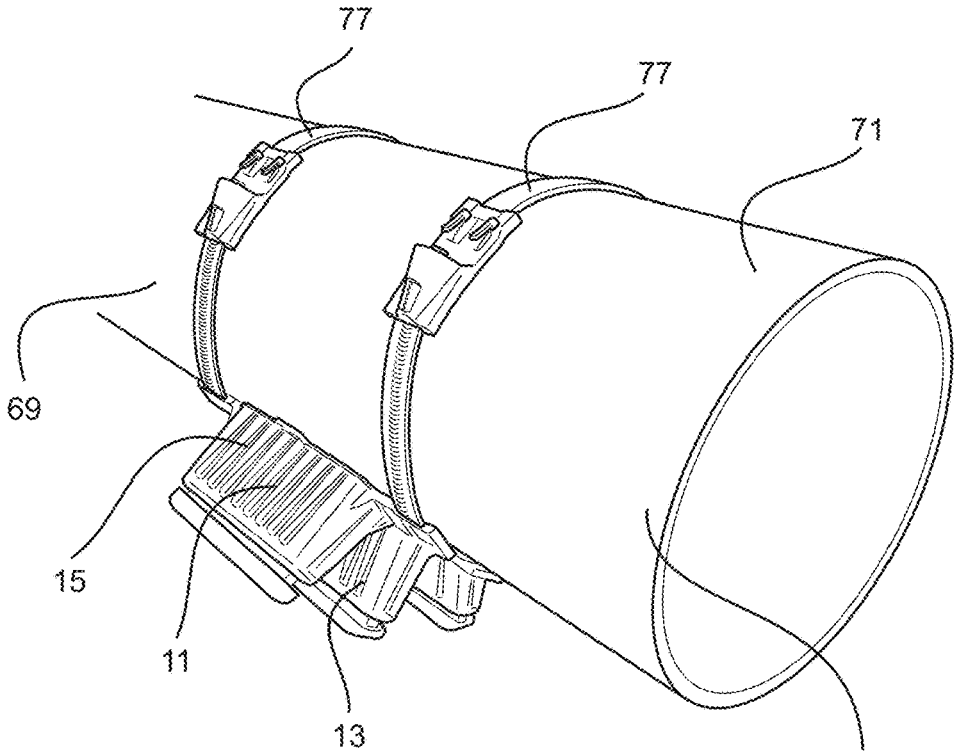
FIG. 16 is a perspective view of a spacer in a third application, the spacer comprising a spacer segment and two extension straps to secure the spacer segment to a first surface, the first surface being provided by the external surface of a pipe.

FIG. 16 depicts a third application wherein the first pipe 71 is required to be supported and spaced from the second pipe 73 along its bottom. In this application the spacer 11 comprises a spacer segment 13 and two pairs of extension straps 77 (only one pair is visible) wherein the spacer segments 13 is fitted to the bottom of the first pipe 71.

The above applications utilise spacers which are fitted around the perimeter of the first surface, as provided by the external surface of the first pipe. However, there are applications where it is advantageous to have the spacer 13 fitted to the inner surface of 73 of the second pipe 75. In these applications the first surface 61 is provided by the inner surface of 73 of the second pipe 75, and the second surface 63 is provided by the outer surface 69 of the first pipe 71. In these embodiments it may not be necessary to form a spacer which is circular in shape, and may in fact comprise one or more spacer segments which are only located at the desired positions of the first surface, as for example is represented in FIG. 17.

These applications include those circumstances where the inner surface 73 of the second pipe 75 is particularly rough. Not only will this create friction on the wear pad of the spacer fitted to the first pipe 71, it will also quickly wear and damage the wear pad 25. In these circumstances it is more effective to fit the spacer segments 11 to the rough surface.

Figure 17:
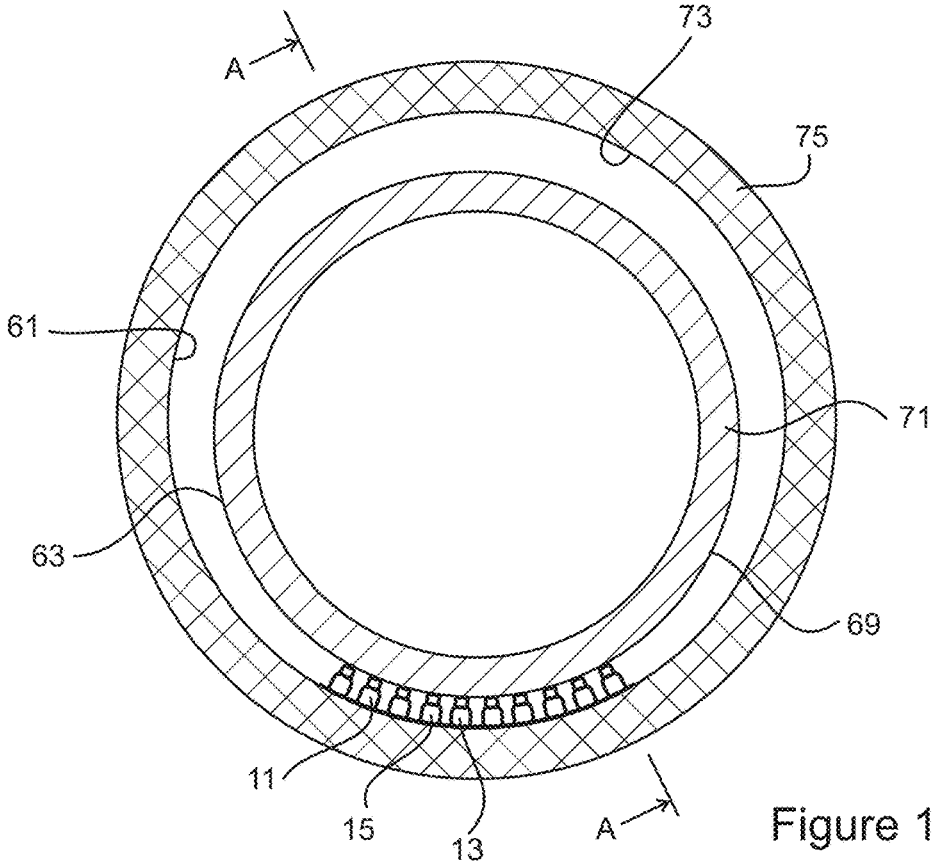
FIG. 17 is a cross sectional end view of a spacer in a fourth application, the spacer comprising a plurality of spacer segments fitted to a first surface, the first surface being provided by a portion of an internal surface of an enveloper, being a bore casing, the bore casing receiving a pipe, the external surface of the pipe providing a second surface.
Figure 18:
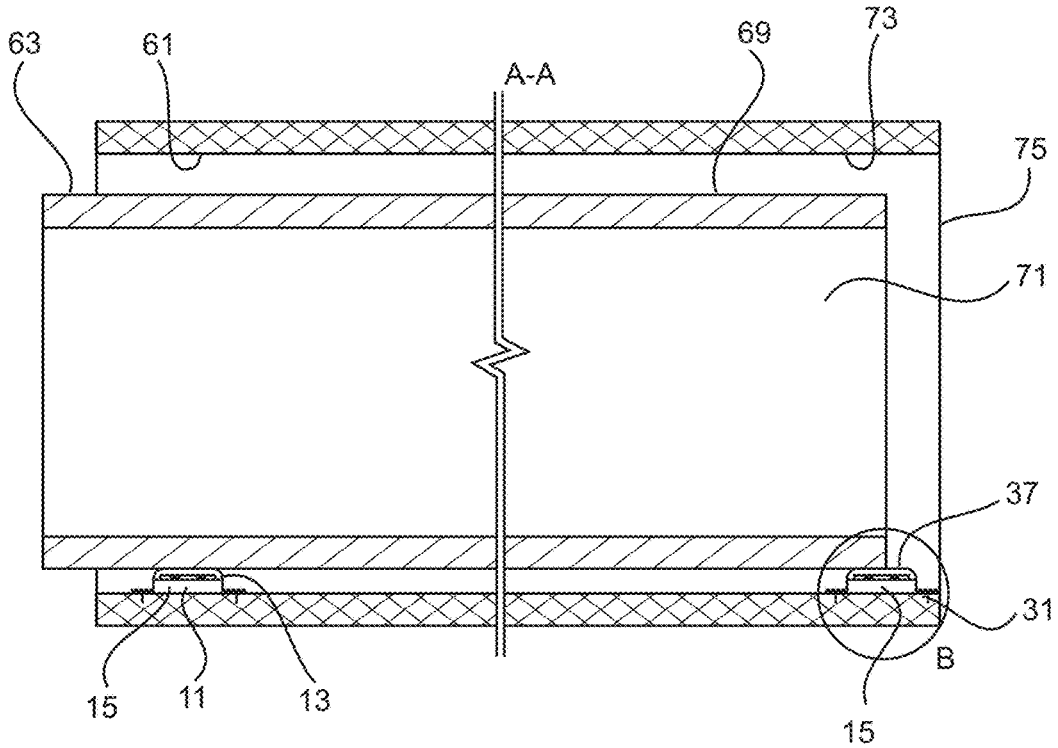
FIG. 18 is a cross sectional side view of FIG. 17 through section AA showing two spacers spaced apart from each.
Figure 19:
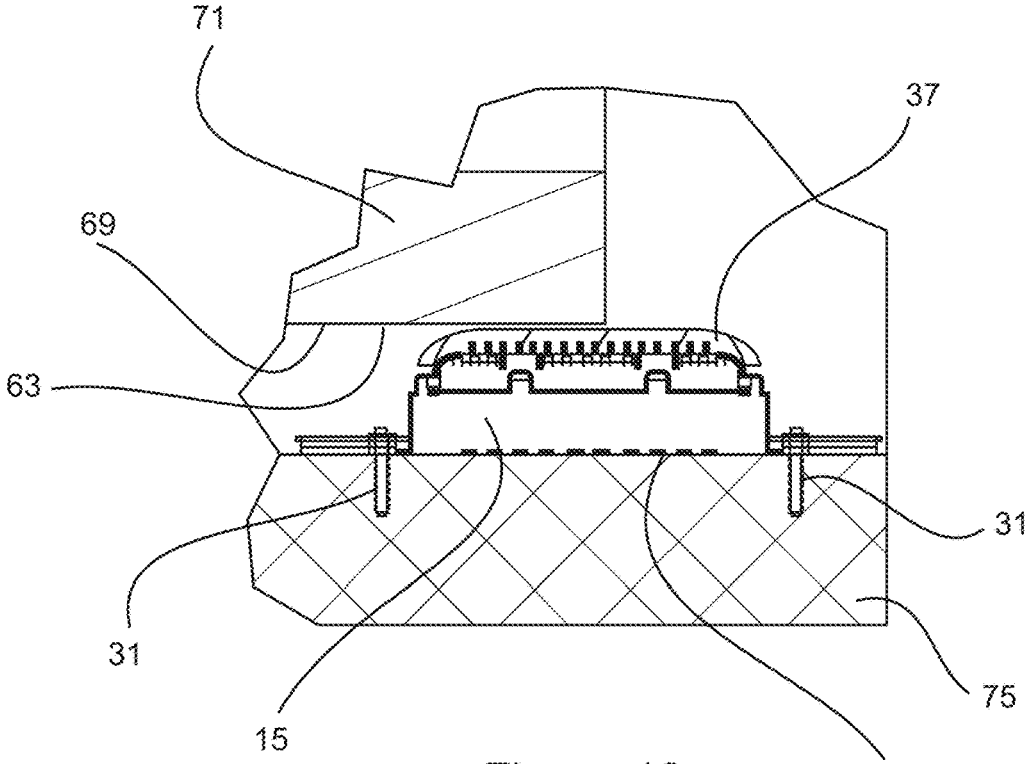
FIG. 19 is a close up view of section B in FIG. 18.

Referring to FIGS. 17 to 19 a fourth application is shown wherein the spacer 11 is secured to the first surface 61, being the inner surface 73 of the second pipe 75, by a plurality of screws 31. In this application the inner surface of 73 of the second pipe 75 may not be continuous, as may be the case at a junction of two joined pipes which may not be properly aligned. By placing spacers 11 adjacent the junction, the first pipe 71 can pass unaffected over the junction during installation.

Figure 20:
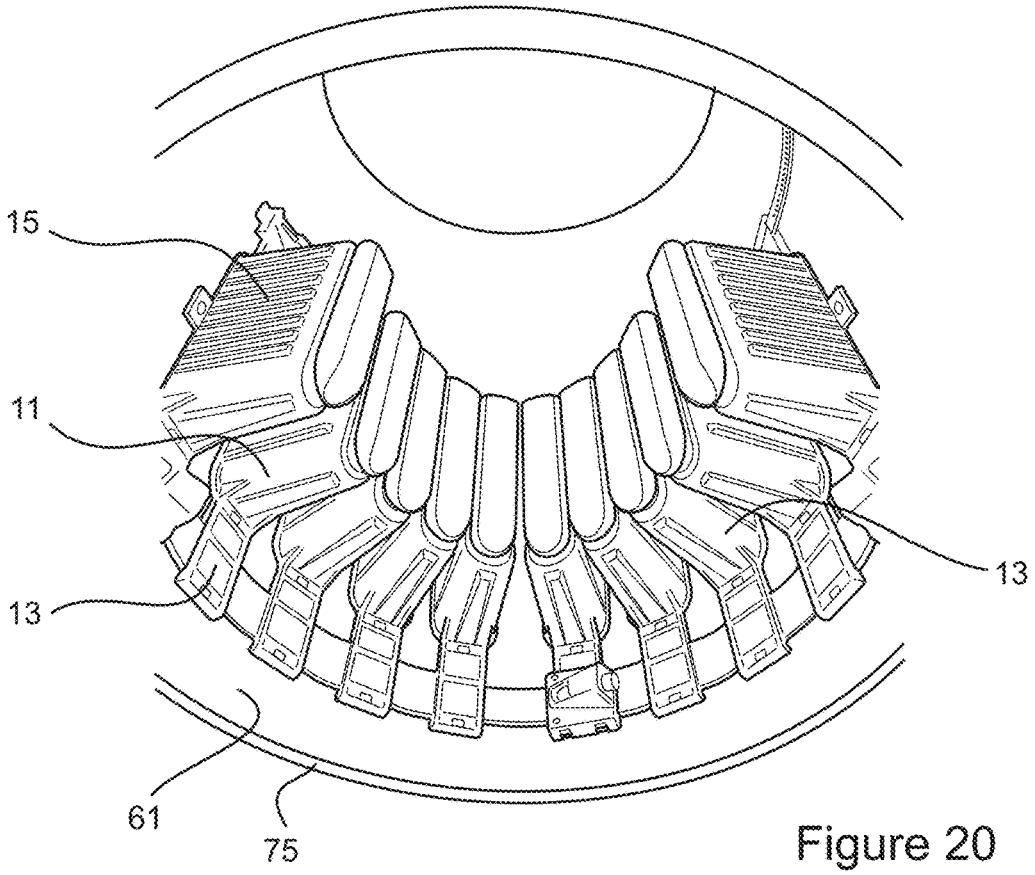
FIG. 20 are perspective views of a spacer in a fifth application, the spacer comprising two spacer segments, the spacer segments are fitted to a first surface, the first surface being provided by an internal surface of an enveloper, being a bore casing, the spacer segments comprising deeper support assemblies to accommodate the installation of a pipe having a considerably smaller diameter than the bore casing, the external surface of the pipe providing the second surface.
Figure 21:
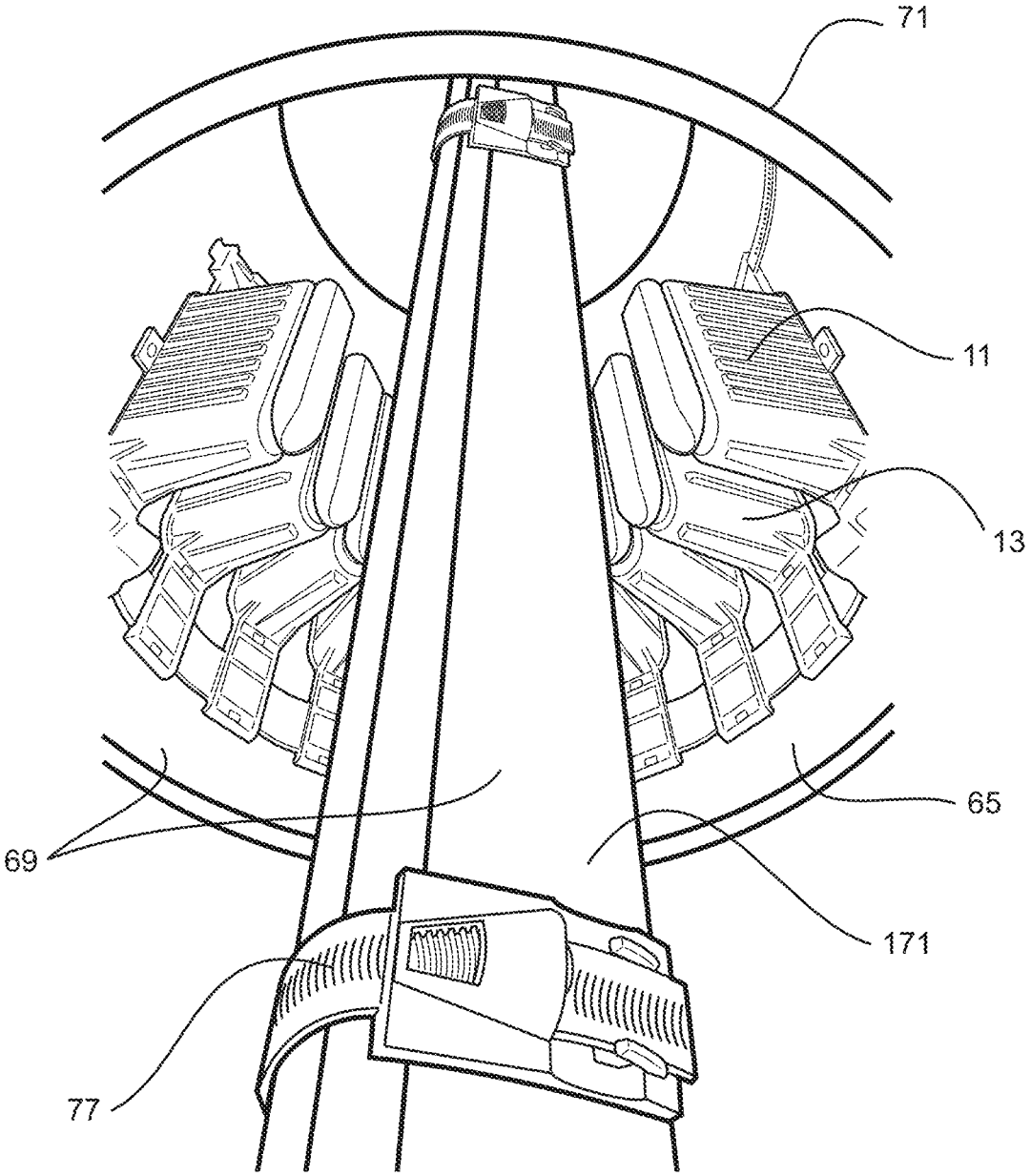
FIG. 21 is a similar view to FIG. 20 with a pipe received therein.

The configuration of the spacer 11 of the fifth application represented in FIGS. 20 and 21 is similar to the fourth application. In this application the height/depth of the support assemblies 15 allows for a cable 171 of much smaller diameter than the second pipe 75 to be installed and supported in the larger second pipe 75. This arrangement would also apply to a small diameter tube/pipe, as may be found, for example, in grout pumping applications.

Referring to FIGS. 22 to 25 a spacer segment 213 according to a second embodiment has conveyancing means associated therewith. In particularly one or more support assemblies 215 of the spacer segment 213 may support the conveyancing means.

The conveyancing means represented in FIGS. 22 to 25 is in the form of two wheel sets fixed relative to the support assembly 15. Each wheel set 79 comprise an axle 81 and a pair of wheels 83 whereby the wheels are located either side of the body 235 of the support assembly 215, and are positioned such that a portion of each wheel is above the contact surface 239 of the wear pad 237.

Figure 22:
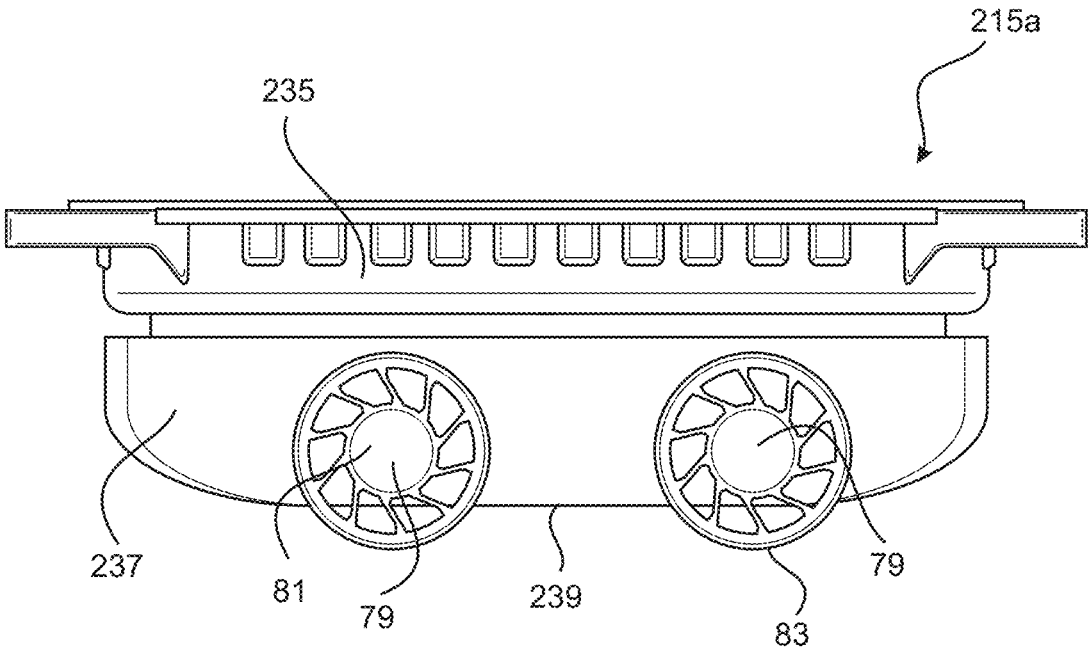
FIG. 22 is a side perspective view of a support assembly of a spacer segment according to a second embodiment of the invention, the support assembly having a conveyancing means secured thereto.
Figure 23:
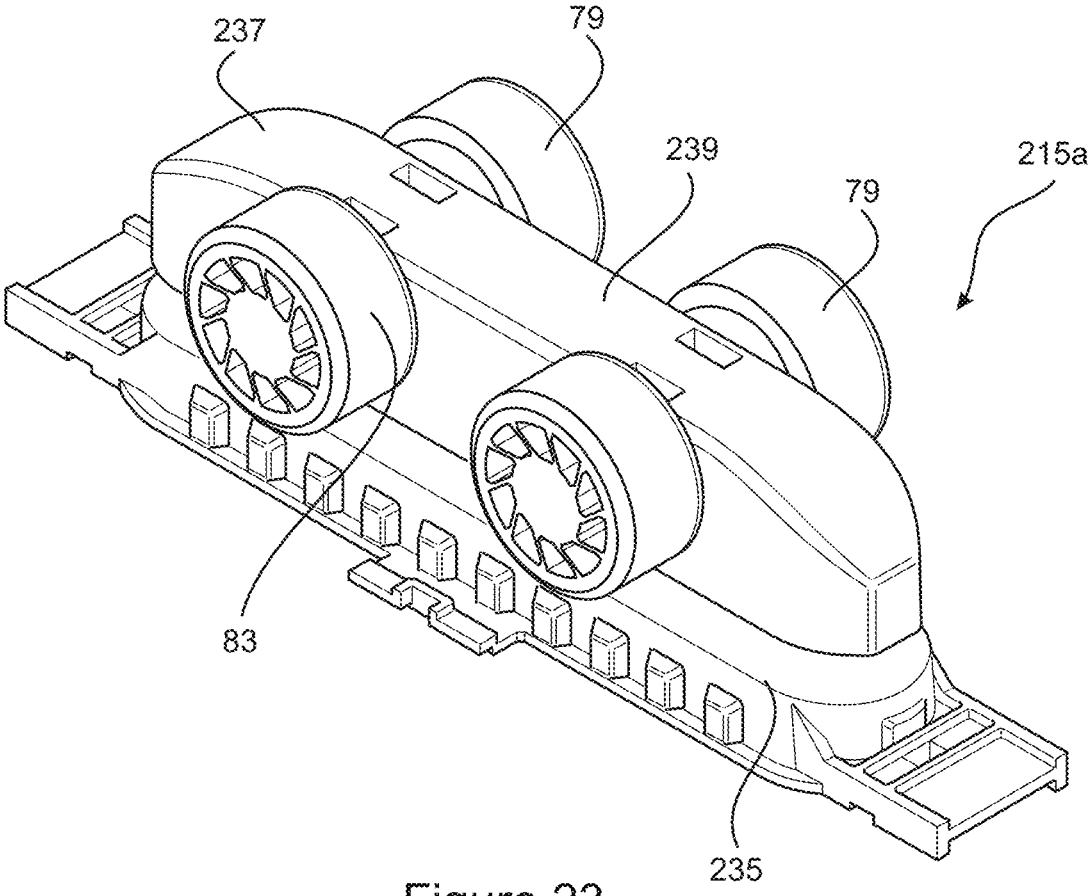
FIG. 23 is a bottom perspective view of the support assembly shown in FIG. 22.

The support assembly 215*a* shown in FIGS. 22 and 23 have the wheel sets 79 of the conveyancing means installed relative to the wear pad 237. In this regard the axle is supported in a bore passing through the wear pad.

Figure 24:
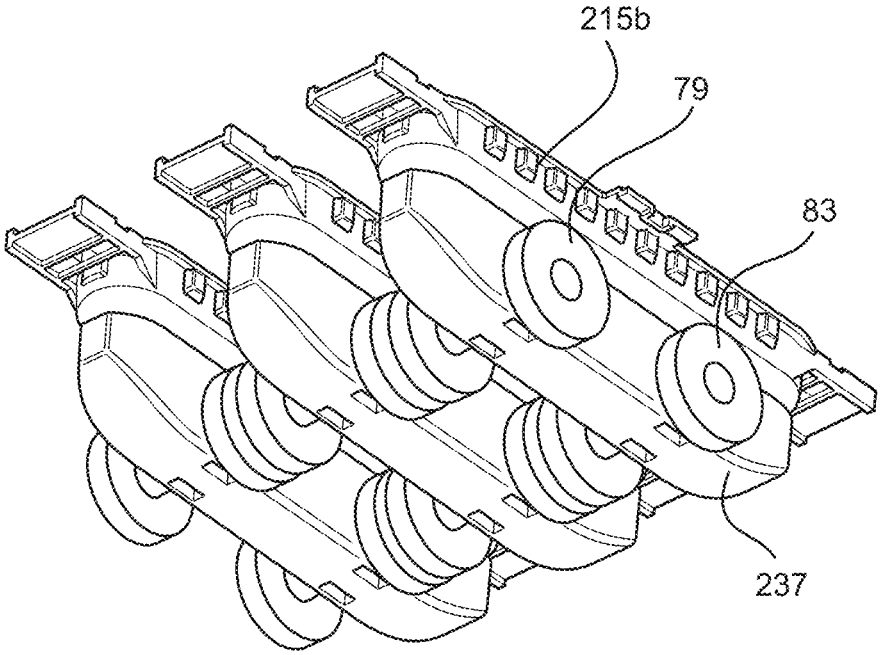
FIG. 24 is a bottom perspective view of three support assemblies of a spacer segment according to a third embodiment of the invention, each support assembly having a conveyancing means secured thereto, the conveyancing means being of an alternate type to that shown in FIG. 22.
Figure 25:
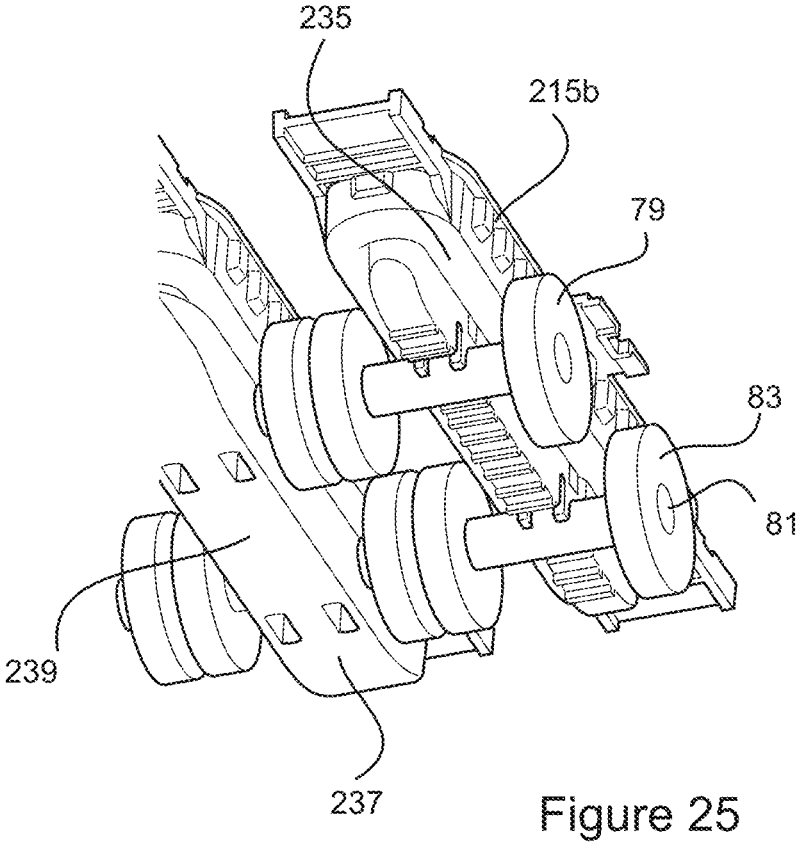
FIG. 25 is a partial view of FIG. 24 with a wear pad removed from the support assembly.

The support assemblies 215*b* shown in FIGS. 24 and 25 have the wheel sets 79 of the conveyancing means installed relative to and supported by the body 235 rather than the wear pad 237, as best shown in FIG. 25.

Depending on the required application, one or more of the support bodies of a spacer segment 13 may incorporate conveyancing means.

Referring to FIGS. 26 to 30, the spacer 211 formed from one or more spacer segments 213 according to the second embodiment is shown, as it may be applied in different applications.

Figure 26:
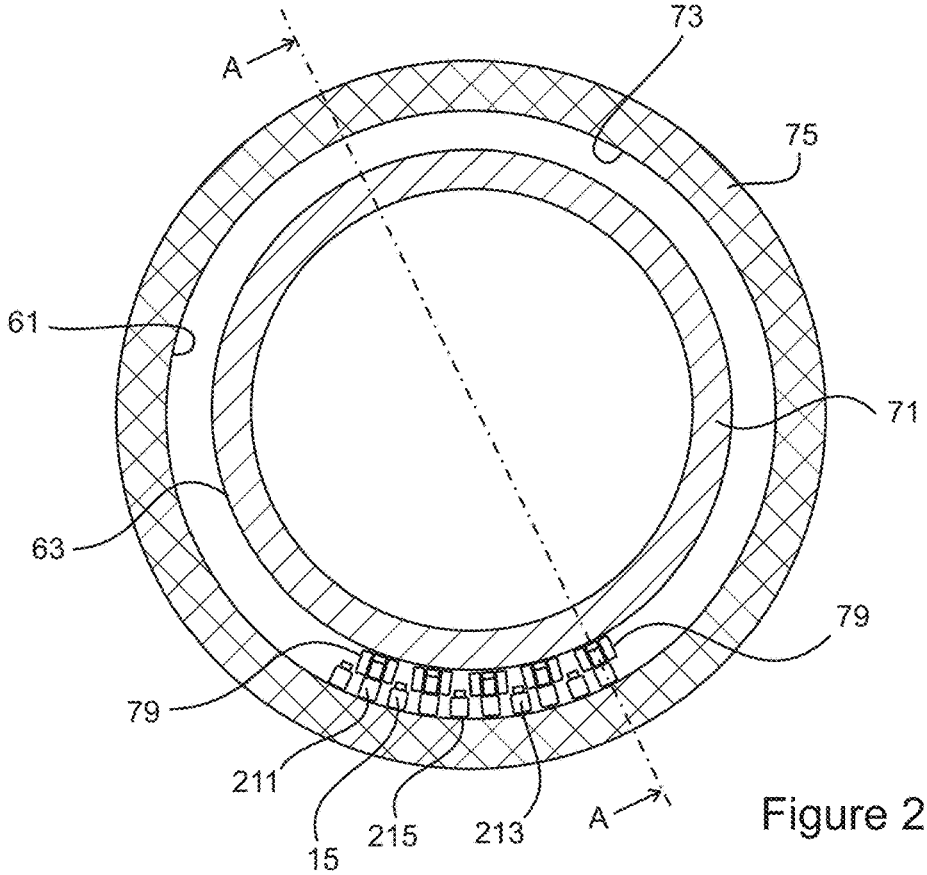
FIG. 26 is a cross sectional end view of a spacer in a sixth application, the spacer comprising two spacer segments according to the second embodiment fitted to a first surface, the first surface being provided by a portion of an internal surface of an enveloper, being a bore casing, the bore casing receiving a pipe, the external surface of the pipe providing a second surface.
Figure 27:
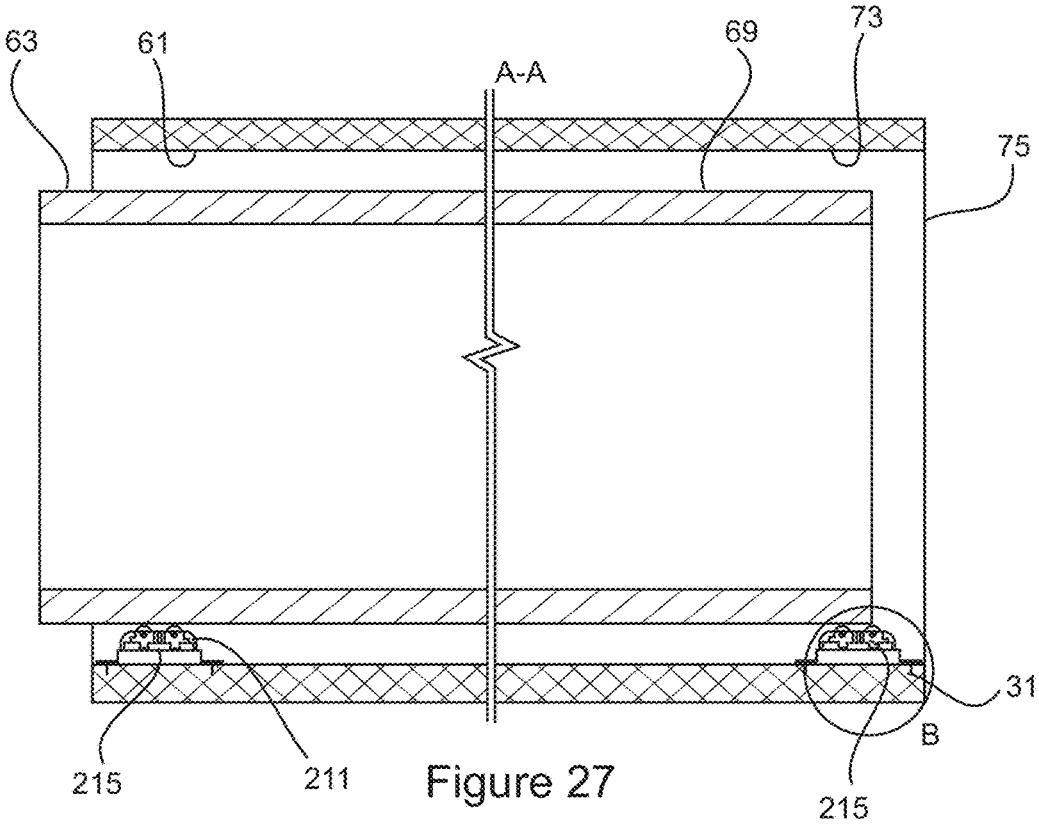
FIG. 27 is a cross sectional side view of FIG. 26 through section AA showing two spacers spaced apart from each.
Figure 28:
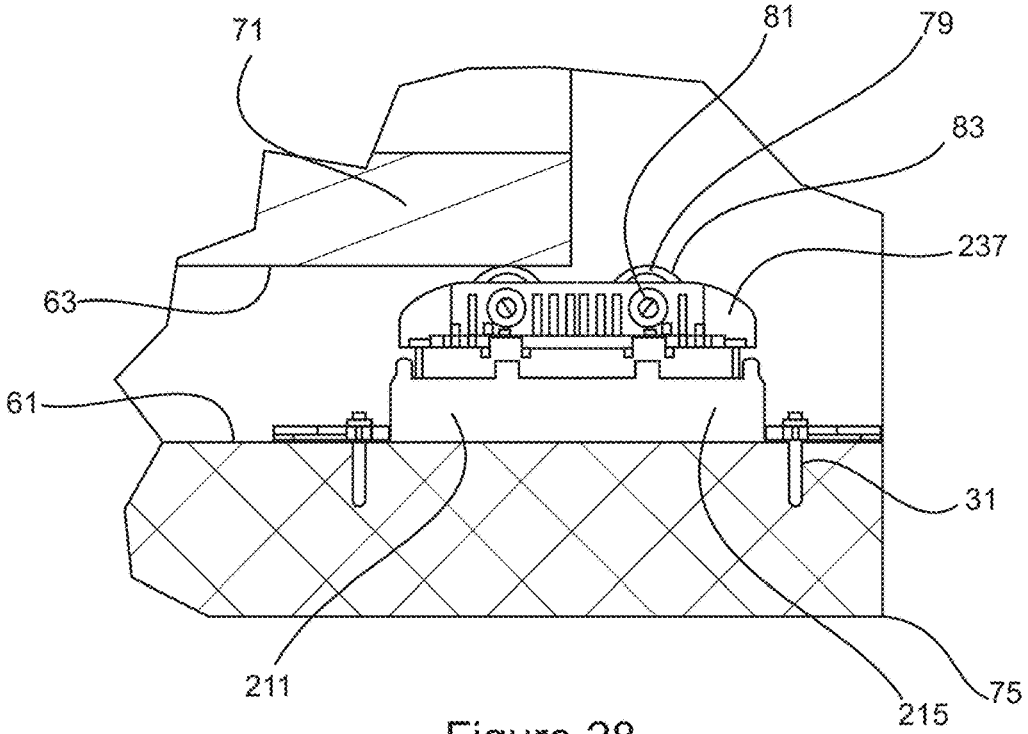
FIG. 28 is a close up view of section B in FIG. 27.

Referring to FIGS. 26 to 28 a sixth application is shown wherein the spacer 211 is secured to the first surface 61, being the inner surface of 73 of the second pipe 75, by a plurality of screws 31. In this application the inner surface of 73 of the second pipe 75 may not be continuous, as may be the case at a junction of two joined pipes which may not be properly aligned. By placing spacers 11 adjacent the junction, the first pipe 71 can pass unaffected over the junction during installation. To further assist the installation the spacer 211 is formed from two spacer segments 213 having a pair of wheel sets 79 supported by alternate support assemblies, as best shown in FIG. 26.

Figure 29:
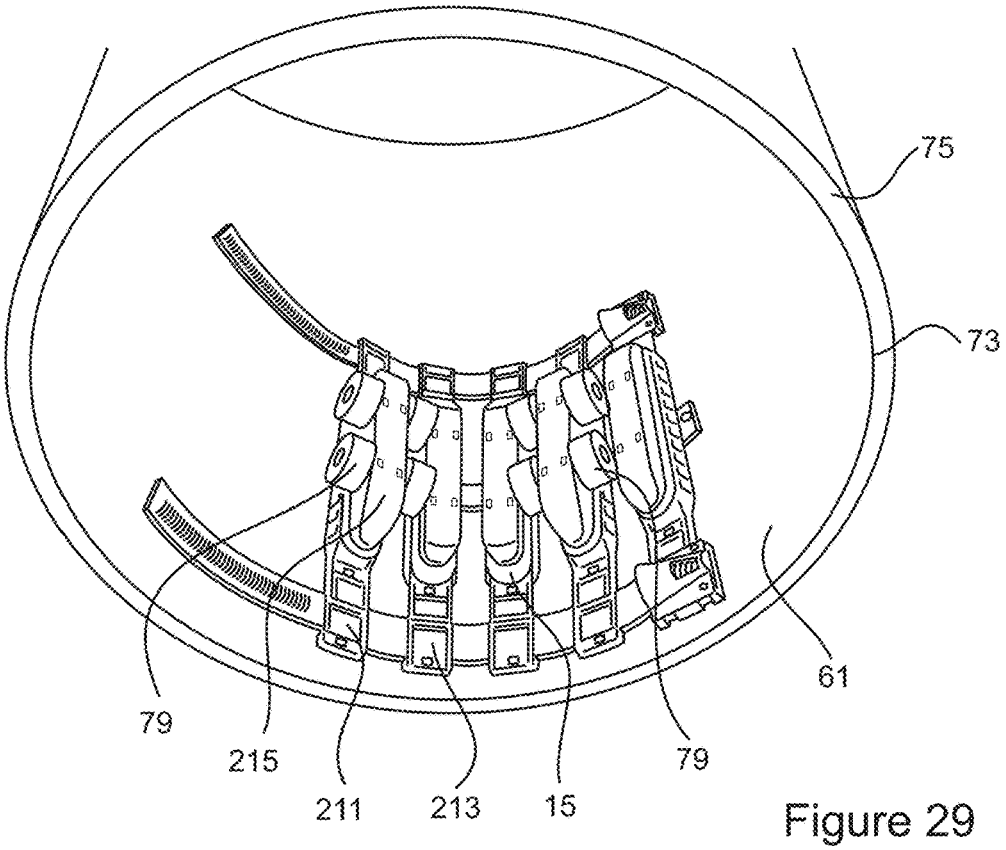
FIG. 29 is a perspective view of the bore casing shown in FIG. 26 with a spacer segment in position.
Figure 30:
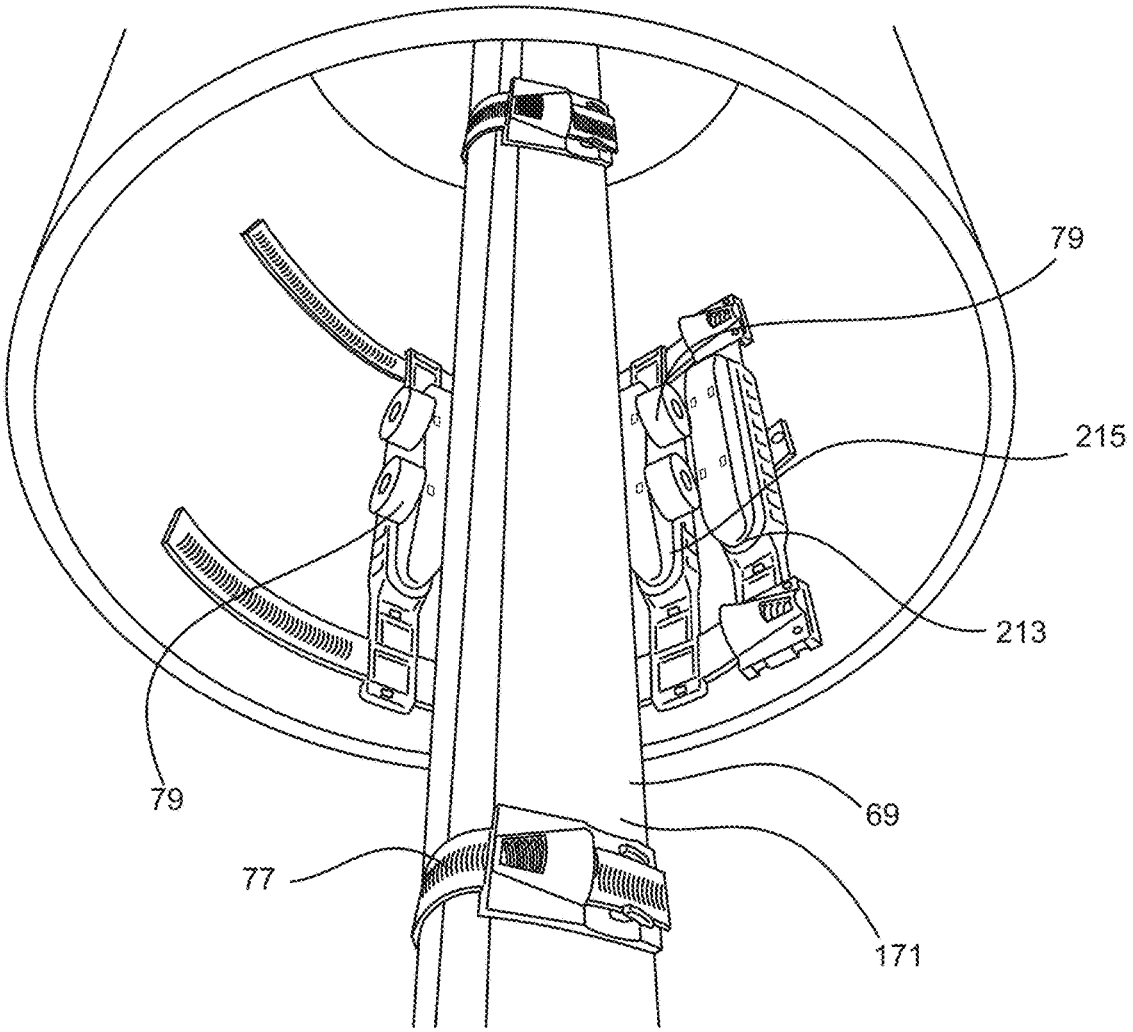
FIG. 30 is a similar view to FIG. 29 with a pipe received therein.

Referring to FIGS. 29 and 30 a seventh application is shown wherein the spacer 211 is secured to the first surface 61, being the inner surface of 73 of the second pipe 75, by a plurality of screws 31. The spacer 211 is formed from a spacer segment 213 having a pair of wheel sets 79 supported by two support assemblies, as best shown in FIG. 29

Modifications and variations such as would be apparent to the skilled addressee are considered to fall within the scope of the present invention. The present invention is not to be limited in scope by any of the specific embodiments described herein. These embodiments are intended for the purpose of exemplification only. Functionally equivalent products, formulations and methods are clearly within the scope of the invention as described herein.

Similarly the spacers may be configured to ensure the pipe is supported at the correct positions and orientations. For example, spacer segments can be fixed to the inner surface of the enveloper at the upper portion. This assists in controlling the floatation of the inner/first pipe as may occur during the grouting process. As another example, spacer segments may be positioned to support the first pipe at its upper sides such that movement of the first pipe relative to the enveloper is restricted to remain in acceptable tolerance with a vertical longitudinal plane of the enveloper.

Each document, reference, patent application or patent cited in this text is expressly incorporated herein in their entirety by reference, which means that it should be read and considered by the reader as part of this text. That the document, reference, patent application or patent cited in this text is not repeated in this text is merely for reasons of conciseness.

Reference to positional descriptions, such as lower and upper, are to be taken in context of the embodiments depicted in the figures, and are not to be taken as limiting the invention to the literal interpretation of the term but rather as would be understood by the skilled addressee.

While the invention has been shown and described with reference to certain exemplary embodiments thereof, it will be understood by those skilled in the art that various changes in form and details may be made therein without departing from the spirit and scope of the invention as defined by the appended claims.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprise", "comprises," "comprising," "including," and "having," or variations thereof are inclusive and therefore specify the presence of stated features, integers, steps, operations, elements, and/or components, but do not preclude the presence or addition of one or more other features, integers, steps, operations, elements, components, and/or groups thereof.

When an element or layer is referred to as being "on", "engaged to", "connected to" or "coupled to" another element or layer, it may be directly on, engaged, connected or coupled to the other element or layer, or intervening elements or layers may be present.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The invention claimed is:

1. A spacer segment wherein one or more spacer segments are adapted to be interconnected and fitted to/on a first surface, the spacer segment comprises a first collar portion, a second collar portion, and at least one support assembly extending between the first collar portion and the second collar portion to maintain the collar portions in spaced relation to each other, the at least one support assembly comprises a body having a body portion and a mounting portion, the at least one support assembly further comprises a contact surface adapted to engage a second surface of a structure, and a suspension means for biasing the contact surface away from the body, wherein the suspension means is in the form of a resilient portion extending between the body portion and the mounting portion, wherein the at least one support assembly is movable from a normal position, wherein no or minimal force is exerted on the support assembly and the contact surface is biased away from the body, to a compressed position, wherein the at least one support assembly supports a load or a portion of a load, whereupon the contact surface is caused to move towards the body, the contact surface is provided by a wear pad which is adapted to be releasably attached to the mounting portion of the body of the support assembly.

2. The spacer segment according to claim 1 wherein the body of each support assembly extends between the first collar portion and the second collar portion, wherein the body has a cavity with an opening, the opening being positioned adjacent the first surface when the spacer segment is fitted thereto.

3. The spacer segment according to claim 1 wherein the contact surface is elongate in shape whereupon installation, a longitudinal axis of the contact surface is orientated to extend along the direction the first surface and second surface move relative to each other.

4. The spacer segment according to claim 1 wherein the contact surface has a ramped section at one or both ends.

5. The spacer segment according to claim 1 wherein the wear pad is positioned adjacent the second surface when the spacer segment is fitted to the first surface.

6. The spacer segment according to claim 1 wherein the wear pad is movable relative to the body such that the support assembly moves between the normal position, whereby the pad is most distant from the body, and the compressed position, whereby the wear pad is closer to the body.

7. The spacer segment according to claim 1 wherein the suspension means is incorporated in the body and a wear pad is releasably attached relative to the suspension means, whereby the suspension means is located between the wear pad and the body.

8. The spacer segment according to claim 1 wherein the suspension means biases the wear pad away from the body such that when the support assembly has no load thereon the support assembly is in the normal position.

9. The spacer segment according to claim 1 wherein the resilient portion is in the form of a flexible wall portion.

10. The spacer segment according to claim 9 wherein the wall portion has a s-shaped cross sectional profile.

11. The spacer segment according to claim 9 wherein the wall portion has a first edge which extends substantially or at least 50% around the perimeter of the mounting portion, and a second edge which extends substantially or at least 50% around the perimeter of the body portion.

12. The spacer segment according to claim 9 wherein the mounting portion, the body portion and the wall portion are integrally formed.

13. The spacer segment according to claim 1 wherein the support assembly provides a conveyancing means, wherein the conveyancing means comprise one or more wheels located either side of the body.

14. The spacer segment according to claim 13 wherein the conveyancing means is secured to a wear pad.

15. A spacer adapted to be fitted to a first surface, the spacer comprises one or a plurality of spacer segments according to claim 1 wherein ends of spacer segments are connected to its adjacent spacer segment via their first and second connector elements, wherein the spacer incorporates one or more extension straps extending between adjacent spacer segments.

16. A spacer comprising at least one or more spacer segments according to claim 1.

17. A spacer segment comprising a first collar portion, a second collar portion, the collar portions having an inner face and an outer face, the spacer segment further comprising at least one support assembly extending between the first collar portion and the second collar portion to maintain the collar portions in a fixed spaced relation to each other, the at least one support assembly comprising a suspension means provided by a resilient wall portion and a contact portion which is biased by the suspension means in a spaced relation from the outer face of the collar portions, the contact portion is adapted to move between a normal position wherein the spacer segment has no load thereon, toward a compressed position, wherein the spacer segment has a load thereon, the resilient wall portion is integrally formed so as to be incorporated with the body, wherein the resilient wall portion flexes as load is applied thereto;

a first connector element provided at one end of each of the collar portions wherein the first connector element comprises a passage formed along the respective collar portion to extend inwardly from the respective end and second connector element provided at the other end of each of the collar portions, the second connector element comprising an elongate element which in use is able to be received in the passage to be slidable along the passage, wherein the first connector elements are engageable with the second connector elements of the same or another spacer segment such that one or more spacer segments are able to form a spacer which in use is capable of being received around a first surface such that the elongate element is received between the inner face and the second surface, the first connector element having an adjustment element cooperating with the passage and the elongate element to control the position of the elongate element within the passage, wherein the adjustment element comprises a threaded element rotatably supported adjacent the passage and wherein the elongate element is formed with a set of serrations along at least a portion of its length, the spacing between the serrations conforming to the thread of the threaded element, wherein in use when the elongate element is received in the passage the thread of the threaded element is engaged with the serrations such that rotation of the threaded element causes relative displacement between the passage and the elongate element;

wherein the suspension means biases the contact portion towards the normal position, such that when any load is removed from the spacer segment the contact portion returns to the normal position.

18. The spacer segment according to claim 17 wherein the at least one support assembly comprise a body and a removable pad, wherein the pad is releasably attached to the suspension means and provides the contact portion.

19. The spacer segment according to claim 18 wherein the suspension means is provided by the body and extends between the pad and the body, wherein the suspension means biases the pad away from the body such that when the support assembly has no load thereon the support assembly is in the normal position.

20. A spacer segment wherein one or more spacer segments are adapted to be interconnected and fitted to/on a first surface, the spacer segment comprises a first collar portion, a second collar portion, and at least one support assembly extending between the first collar portion and the second collar portion to maintain the collar portions in a fixed spaced relation to each other, the at least one support assembly being movable from a normal position, wherein no or minimal force is exerted on the support assembly, to a compressed position, wherein the support assembly supports a load or a portion of a load, the at least one support assembly comprising a body portion and a wear pad interconnected by a suspension means, the suspension means is provided by a resilient wall portion, the resilient wall portion being integrally formed so as to be incorporated with the body portion, the wall portion has a curved cross sectional profile which spans between a first edge extending substantially around the perimeter of a mounting portion, and a second edge extending substantially around the perimeter of the body portion, wherein the resilient wall portion flexes as load is applied thereto, the wear pad is releasably attached to the mounting portion.

21. A spacer segment wherein one or more spacer segments are adapted to be interconnected and fitted to/on a first surface, the spacer segment comprises a first collar portion, a second collar portion, and at least one support assembly extending between the first collar portion and the second collar portion to maintain the collar portions in spaced relation to each other, the at least one support assembly comprises a body having a body portion and a mounting portion, the at least one support assembly further comprises a contact surface adapted to engage a second surface of a structure, and a suspension means for biasing the contact surface away from the body, wherein the suspension means is in the form of a resilient portion extending between the body portion and the mounting portion, the resilient portion being in the form of a flexible wall portion the resilient portion is in the form of a flexible wall portion, wherein the at least one support assembly is movable from a normal position, wherein no or minimal force is exerted on the support assembly and the contact surface is biased away from the body, to a compressed position, wherein the at least one support assembly supports a load or a portion of a load, whereupon the contact surface is caused to move towards the body.

* * * * *